US011541264B1

(12) United States Patent
Mallard et al.

(10) Patent No.: US 11,541,264 B1
(45) Date of Patent: Jan. 3, 2023

(54) VERSATILE BENCH AND SMART SEAT FOR AN EXERCISE APPLIANCE

(71) Applicant: Tonal Systems, Inc., San Francisco, CA (US)

(72) Inventors: David Mallard, Mill Valley, CA (US); Ryan Lafrance, San Francisco, CA (US); Thomas Kroman Watt, San Francisco, CA (US)

(73) Assignee: Tonal Systems, Inc., San Francisco, CA (US)

( * ) Notice: Subject to any disclaimer, the term of this patent is extended or adjusted under 35 U.S.C. 154(b) by 8 days.

(21) Appl. No.: 16/902,163

(22) Filed: Jun. 15, 2020

Related U.S. Application Data

(60) Provisional application No. 62/869,959, filed on Jul. 2, 2019.

(51) Int. Cl.

| | |
|---|---|
| ***A63B 21/00*** | (2006.01) |
| ***A63B 21/04*** | (2006.01) |
| ***A63B 22/00*** | (2006.01) |
| ***A63B 21/16*** | (2006.01) |

(52) U.S. Cl.
CPC .... *A63B 21/00076* (2013.01); *A63B 21/0442* (2013.01); *A63B 21/151* (2013.01); *A63B 21/169* (2015.10); *A63B 21/4029* (2015.10); *A63B 22/0076* (2013.01); *A63B 2022/0079* (2013.01); *A63B 2220/51* (2013.01)

(58) Field of Classification Search
CPC ..... A63B 21/00; A63B 21/00047; A63B 21/00058; A63B 21/00069; A63B 21/00076; A63B 21/0056; A63B 21/0057; A63B 21/0058; A63B 21/0059; A63B 21/02; A63B 21/04; A63B 21/0442; A63B 21/151; A63B 21/152; A63B 21/153; A63B 21/154; A63B 21/156; A63B 21/159; A63B 21/169; A63B 21/28; A63B 21/285; A63B 21/4043; A63B 22/0076; A63B 22/0087; A63B 2022/0079; A63B 2022/0082; A63B 2022/0084
See application file for complete search history.

(56) References Cited

U.S. PATENT DOCUMENTS

| | | | | |
|---|---|---|---|---|
| 1,013,437 | A * | 1/1912 | Pons | A63B 22/0076 482/72 |
| 7,854,685 | B2 * | 12/2010 | Cole | A63B 21/00181 482/8 |
| 9,901,768 | B1 * | 2/2018 | Wu | A63B 21/4034 |

(Continued)

OTHER PUBLICATIONS

Jose Humberto De La Casas Zolezzi, Design and Control of a Powered Rowing Machine with Programmable Impedance, Cleveland State University, EngagedScholarship@CSU, MSL Academic Endeavors, Aug. 2017.

(Continued)

*Primary Examiner* — Nyca T Nguyen
*Assistant Examiner* — Zachary T Moore
(74) *Attorney, Agent, or Firm* — Van Pelt, Yi & James LLP

(57) ABSTRACT

A controllable tension force is provided on a first cable. The first cable has a terminal end wherein the terminal end is adapted to attach to an accessory. The first cable is coupled to a motor. The first cable and motor are part of a resistance unit. The resistance unit is coupled to a user support unit having a sliding seat.

21 Claims, 19 Drawing Sheets

(56) References Cited

U.S. PATENT DOCUMENTS

| | | | | |
|---|---|---|---|---|
| 10,186,997 | B2 * | 1/2019 | Kurfiss | H02P 9/10 |
| 10,471,297 | B1 * | 11/2019 | Smith | A63B 24/0087 |
| 11,097,148 | B2 * | 8/2021 | Kennington | A63B 21/169 |
| 2011/0195822 | A1 * | 8/2011 | Donofrio | A63B 1/00 482/129 |
| 2017/0319941 | A1 * | 11/2017 | Smith | A63B 21/06 |
| 2018/0021616 | A1 * | 1/2018 | Orady | A63B 21/00181 482/5 |
| 2019/0099652 | A1 * | 4/2019 | Orady | A63B 71/0054 |
| 2020/0047027 | A1 * | 2/2020 | Ward | A61B 5/0205 |
| 2020/0047030 | A1 | 2/2020 | Ward | |
| 2020/0047031 | A1 * | 2/2020 | Orady | A63B 71/0622 |
| 2020/0047053 | A1 | 2/2020 | Ward | |
| 2020/0047054 | A1 | 2/2020 | Ward | |
| 2020/0047055 | A1 | 2/2020 | Ward | |
| 2020/0054929 | A1 | 2/2020 | Ward | |

OTHER PUBLICATIONS

Jung et al., Development of a Motor Driven Rowing Machine with Automatic Functional Electrical Stimulation Controller for Individuals with Paraplegia; a Preliminary Study, ARM—Annals of Rehabilitation Medicine, May 9, 2012.

* cited by examiner

VERSATILE BENCH AND SMART SEAT FOR AN EXERCISE APPLIANCE

CROSS REFERENCE TO OTHER APPLICATIONS

This application claims priority to U.S. Provisional Patent Application No. 62/869,959 entitled VERSATILE BENCH AND SMART SEAT FOR AN EXERCISE APPLIANCE filed Jul. 2, 2019 which is incorporated herein by reference for all purposes.

BACKGROUND OF THE INVENTION

Exercise machines that use cables, for example fixed-track machines and gravity-and-metal based cable machines, are useful for strength training, resistance training, and/or weight lifting, to promote the building of muscle, the burning of fat. and improvement of a number of metabolic factors including insulin sensitivity and lipid levels. In particular, cable exercise machines with a motor and an ability to control force exerted by the motor are useful for strength training. It would be useful if these capabilities could be utilized and such machines adapted to provide other forms of exercise beyond strength training.

BRIEF DESCRIPTION OF THE DRAWINGS

Various embodiments of the invention are disclosed in the following detailed description and the accompanying drawings.

DETAILED DESCRIPTION

Figure 1A:
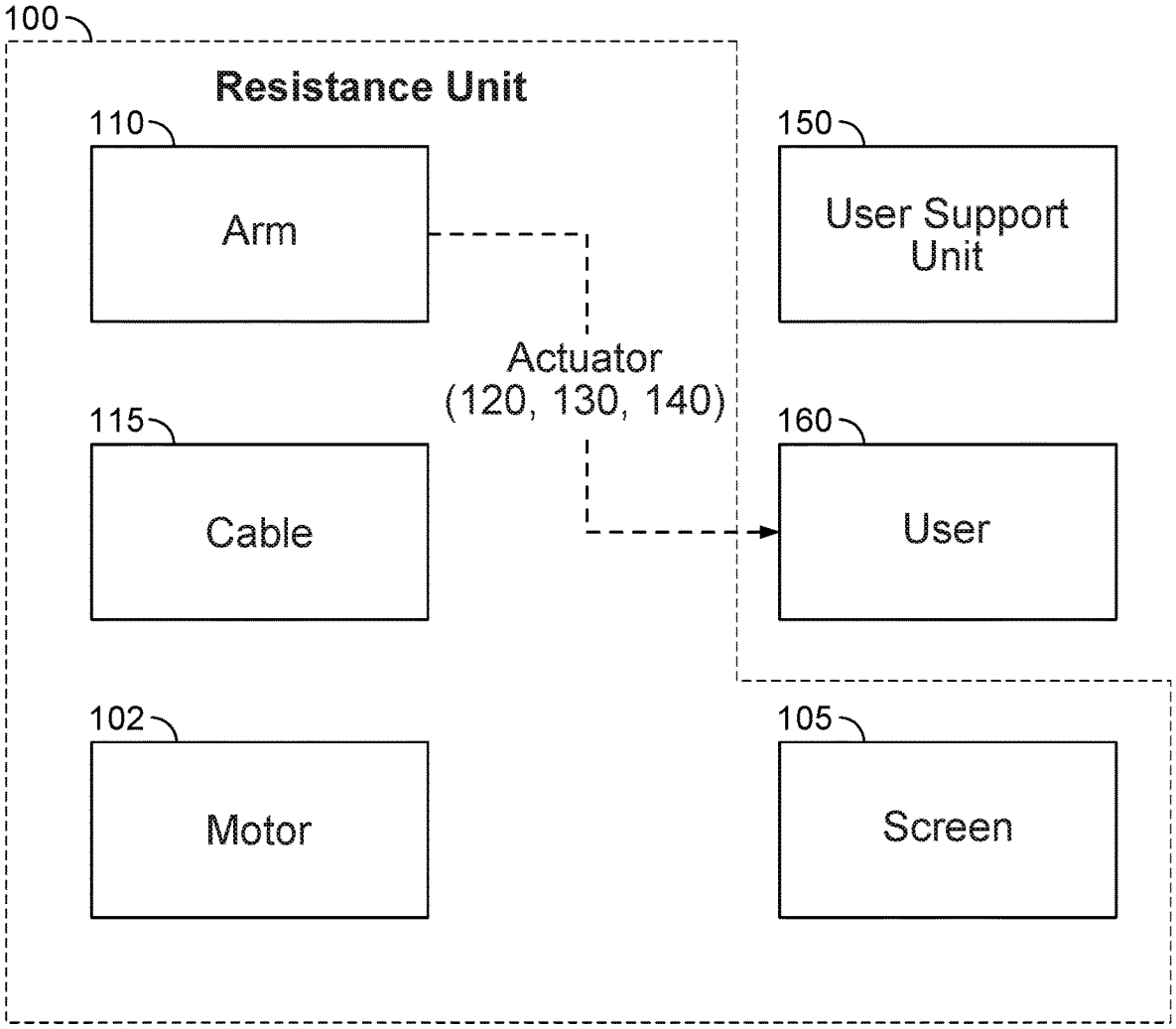
FIG. 1A is a block diagram illustrating an embodiment of a system for an exercise machine.

The invention can be implemented in numerous ways, including as a process; an apparatus; a system; a composition of matter; a computer program product embodied on a computer readable storage medium; and/or a processor, such as a processor configured to execute instructions stored on and/or provided by a memory coupled to the processor. In this specification, these implementations, or any other form that the invention may take, may be referred to as techniques. In general, the order of the steps of disclosed processes may be altered within the scope of the invention. Unless stated otherwise, a component such as a processor or a memory described as being configured to perform a task may be implemented as a general component that is temporarily configured to perform the task at a given time or a specific component that is manufactured to perform the task. As used herein, the term 'processor' refers to one or more devices, circuits, and/or processing cores configured to process data, such as computer program instructions.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

Adapting a cable-based strength training machine for aerobic exercise is disclosed. In one embodiment, a user support unit such as a rowing bench, in part converts a cable-based machine to a rowing machine, and adapting the resistance unit for the cable-based machine in part converts the cable-based machine to the rowing machine. For example, a motor associated with the resistance unit may filter the controllable tension force on a cable associated with the resistance unit to provide a rowing experience to a user of the machine. An important technical challenge to overcome in such a conversion may be the generation of power associated with aerobic exercise by contrast to strength training, for example by proper energy dissipation. Other technical challenges that are overcome include stabilizing cable routing devices such as arms, stabilizing the user support unit/bench to avoid tipping and/or creeping, and managing thermal dissipation.

The advantages of having a strength training machine convertible to an aerobic exercise machine are the reduced space/weight requirements in a user's home/office, reduced economic costs for a user, and a reduced learning curve and fewer errors for a user to using a familiar user interface. For a digital strength training machine, there may be further advantages including: burnout sets, mimicry of environmental conditions such as rowing into the wind, dynamic coaching, power curve matching, tempo matching, video with examples, synchronization with strength training personal data, goal based workout suggestions, game-based/gamificiation-based experiences, and/or community engagement.

FIG. 1A is a block diagram illustrating an embodiment of a system for an exercise machine. Motor (102) is coupled to cable (115), which is routed via arm (110) to an actuator (120). The terminal end of the cable is adapted to attach to other actuators/accessories (130), (140) as well. The user (160) grips one of these actuators (120)/(130)/(140) during use and may make use of a screen (105). The resistance unit (100) includes the motor (102), cable (115), arm (110), and screen (105). The user is supported by a user support unit (150).

Motor (102) may be a hub motor, wherein hub motors are three-phase permanent magnet BLDC direct drive motors in an "out-runner" configuration: as described herein, out-runner motors (102) are motors (102) where permanent magnets are placed outside the stator rather than inside, as opposed to many motors which have a permanent magnet rotor placed on the inside of the stator as they are designed more for speed than for torque. Out-runners have the magnets on the outside, allowing for a larger magnet and pole count and are designed for torque over speed. Another way to describe an out-runner configuration is when the shaft is fixed and the body of the motor rotates.

Hub motor (102) also tends to be "pancake style". As described herein, a pancake motor (102) is higher in diameter and lower in depth than most motors. Pancake style motors are advantageous for a wall mount, subfloor mount, and/or floor mount application where maintaining a low depth is desirable, such as a piece of fitness equipment to be mounted in a consumer's home or in an exercise facility/area. As described herein, a pancake motor (102) is a motor that has a diameter higher than twice its depth. As described herein, a pancake motor (102) may be between 15 and 60 centimeters in diameter, for example 22 centimeters in diameter, with a depth between 6 and 15 centimeters, for example a depth of 6.7 centimeters.

Motor (102) may also be "direct drive", meaning that the motor does not incorporate or require a gear box stage. Many motors are inherently high speed low torque but incorporate an internal gearbox to gear down the motor to a lower speed with higher torque and may be called gear motors. Direct drive motors (102) may be explicitly called as such to indicate that they are not gear motors.

Using the motor (102) providing a controllable tension force on the cable (115) for a strength training machine to be used as an aerobic exercise machine is disclosed. The cable (115) is routed using an arm (110) and its terminal end is adapted to attach to one or more accessories (120)/(130)/(140).

Figure 1B:
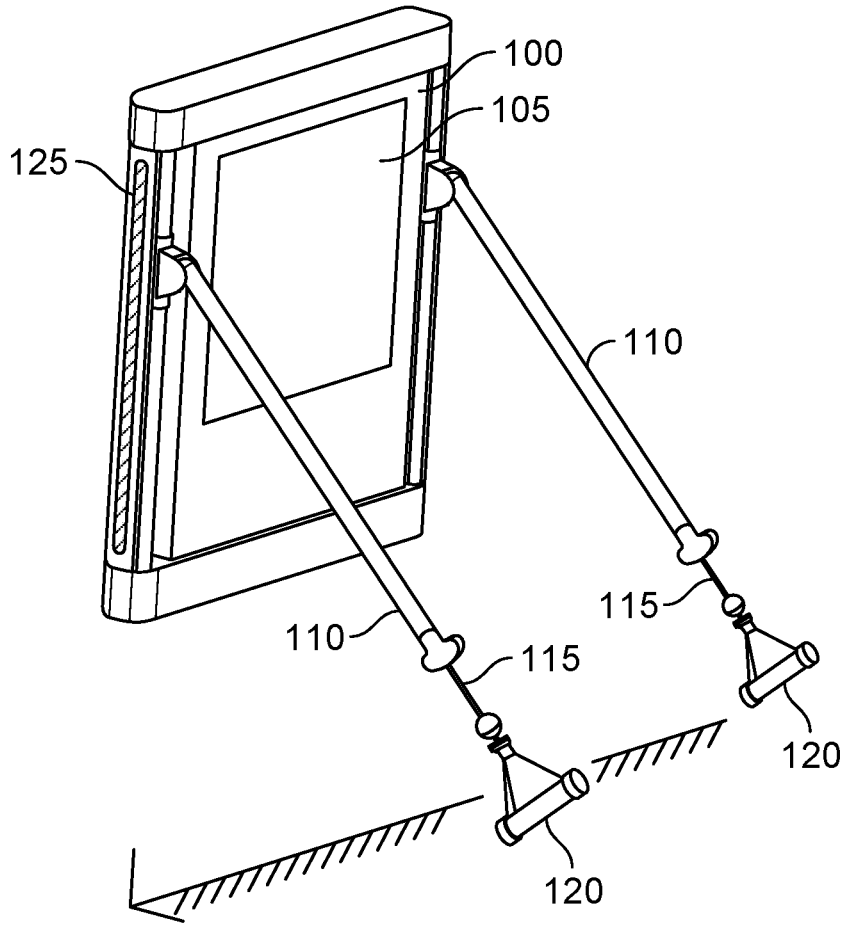
FIG. 1B is an illustration of an embodiment of a system for an exercise machine.

FIG. 1B is an illustration of an embodiment of a system for an exercise machine. As shown in FIG. 1B, the resistance unit (100) includes a screen (105) for example in portrait orientation, to show information to a user. Acoustic information may be provided, either through loudspeakers, sounders, headphones, or wireless, in-ear transducers. The resistance unit (100) also includes at least one arm (110) for example two arms as shown in FIG. 1B.

Arm (110) may be adjusted for translational and/or angular positioning along slots/guide-ways (125), independently from any other arm (110). Arm (110) guides a cable (115) that is coupled to a motor housed somewhere in the resistance unit (100). At the terminal end of cable (115) is an actuator, for example a handle/hand grip (120). The cable ends may be equipped with a coupling mechanism such as a ball stop that allows user grips or stirrups to be attached and/or interchanged so that a user may manipulate the cable extension during the exercise period.

In one embodiment, the motor is used with a collection of drive components, including flexible couplings and pulleys coupled to user grip components as shown in FIG. 1B. The exercise machine comprises at least a drive system and its associated controller to exert a pulling force against which the user of the appliance exercises. The body of the resistance unit (100) is connected and/or fastened to a fixed, relatively rigid surface, such as a wall, or a frame.

Figure 1C:
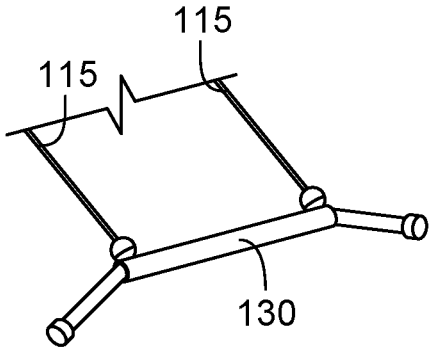
FIG. 1C is an illustration of an embodiment of a two-handed grip actuator and/or rowing handle.
Figure 1D:
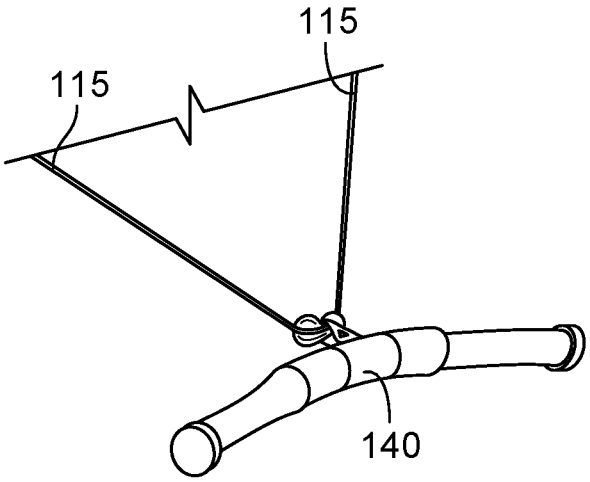
FIG. 1D is an illustration of an embodiment of a bridle actuator/rowing handle.

FIG. 1C is an illustration of an embodiment of a two-handed grip actuator (130) and/or rowing handle. In the configuration of FIG. 1C, cable (115) from each arm (110) is coupled to two separate attachment points on the two-handed grip (130). FIG. 1D is an illustration of an embodiment of a bridle actuator (140) and/or rowing handle. In the configuration of FIG. 1D, this bridle arrangement (140) has an advantage to avoid differential movement of cables (115), where the cables (115) are attached to a single point on grip (140). An advantage of using a couple both cables (115) from each arm (110) is that it permits stronger resistance for stronger rowers to row against.

In one embodiment, the handle grips (120) being independent on different cables and arms enable a "two player" configuration with two users, each with their own user support unit (150) and corresponding one of the two arms, such that the system permits the first user and second user to use the exercise machine simultaneously, for example to race.

Figure 2A:
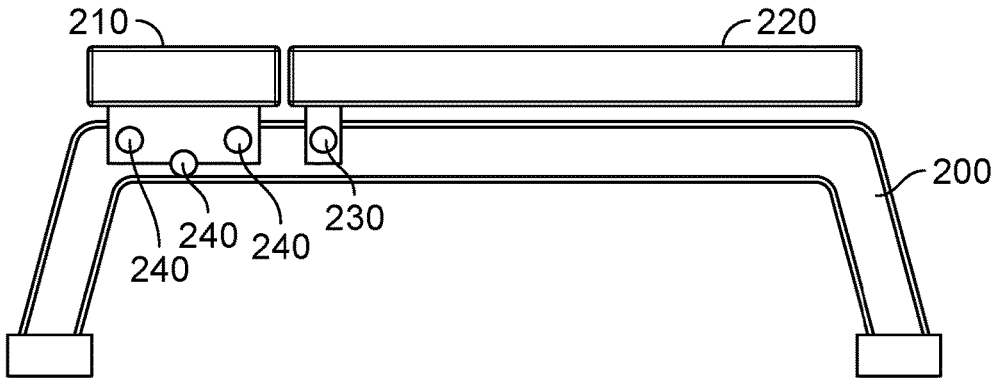
FIG. 2A is a profile illustration of an embodiment of a user support unit.

FIG. 2A is a profile illustration of an embodiment of a user support unit. To demonstrate conversion of a strength training machine to an aerobic exercise machine, a rowing aerobic exercise machine example is used without limitation.

During strength training, a bench is typically used to suspend a user from the floor. Some exercises require that a user's arms have room to move below the line of the prone user's back, for example when a bench press is being performed; this may be with free weights or using a machine that simulates the loading from free weights. One goal in such strength training movements is that loading on the user's limbs be not constrained by the support so that the exercise may be performed properly without hard contact with surroundings. A simple flat unadjustable surface may be adequate to serve as a bench, but by adding mechanical features to the bench as shown in FIGS. 2A, 2B, and 2C, the ability to convert the simple bench helps enable an aerobic exercise use out of the strength training machine.

In FIG. 2A, frame (200) is constructed from a sturdy material, for example steel which may be painted, or a toughened aluminum alloy such as 6061-T6 which may be hard-anodized, for an attractive finish. Beyond a single simple padded user platform, the user support unit/bench is divided into two padded elements. A seat (210) is fitted with rollers and may be unlocked so that it may slide along the upper rail of the frame and locked so that it returns to being braked/stationary. A generally larger padded element (220) is fitted with a hinge mechanism (230) which allows it to be tilted. A locking mechanism (not shown) allows the user to lock this tilt to an angle so that the user may use it as an inclined bench, for a strength training exercise like an incline bench press, or in the fully erect position may be used as a seat back to brace the user for strength training exercises like a pectoral fly.

The hinge element (230) may be disconnected so that the padded element (220) may be removed and the seat component (210) unlocked so that it may slide freely along some or all of the length of the top rail of the frame (200), similar to seats used in dedicated rowing aerobic exercise machines.

Figure 2B:
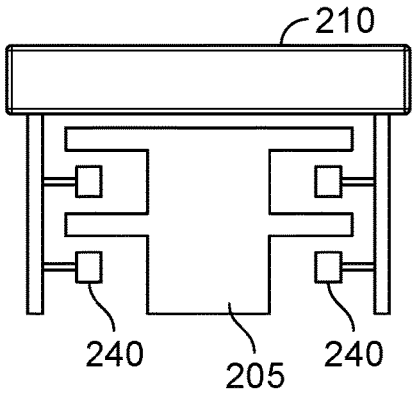
FIG. 2B is a cross-sectional illustration of an embodiment of a user support unit.
Figure 2C:
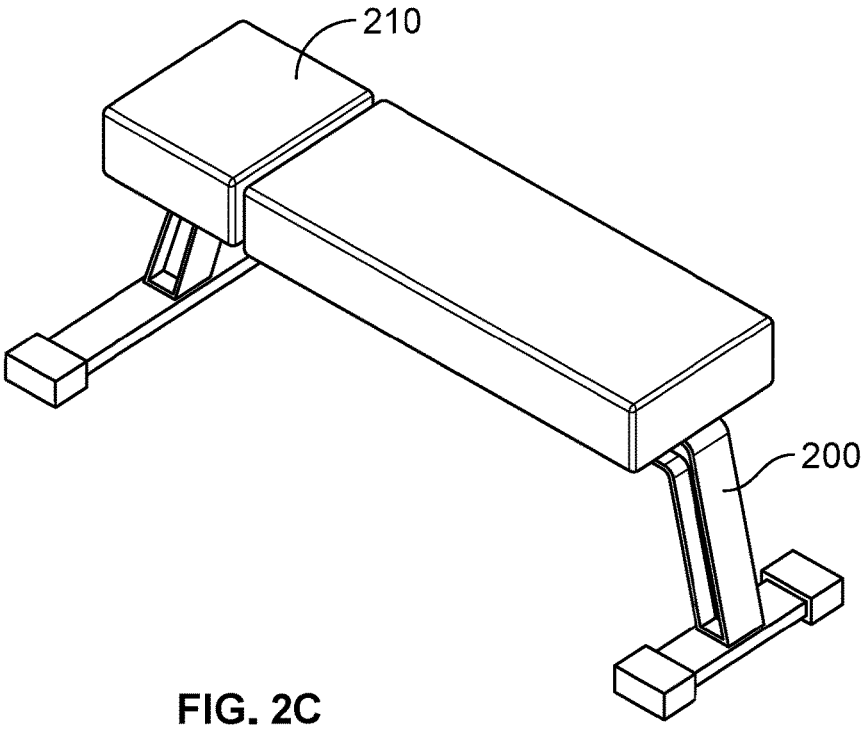
FIG. 2C is an isometric illustration of an embodiment of a user support unit.

FIG. 2B is a cross-sectional illustration of an embodiment of a user support unit. FIG. 2C is an isometric illustration of an embodiment of a user support unit. In FIG. 2B, a cross section of the frame top rail (205) of frame (200) is shown. The seating platform (210) is supported by wheel assembly (240) that may bear the weight and also prevent the seat from leaving the track by lifting away from it. Seat (210) moves freely along the top rail (205), while not tipping or tilting. Sliding friction is reduced to a minimum, for example with wheels (240) equipped with high performance bearings. Typically, these are sealed bearings to prevent ingress of contaminants and reduce the chance of replacement.

In a typical competition rowing boat such as an "eight," a "four" or smaller, seating is often extremely simple, focusing on lowest weight and low friction; an unskilled beginner is often tasked to maintain rowing efficiency whilst remaining balanced on the track on which the seat rides.

In one implementation, seat (210) is equipped with a supplementary set of wheels or rollers that resist sideways motion that may result in rubbing friction between the seat and the rail of the bench. In one embodiment, restricting side loading effects may be alternately achieved by the use of low-friction rubbing strips, such as certain hard plastics or Teflon® based materials at the contact points if the seat is improperly displaced.

Although the seat is relatively heavy when compared to a competitive rowing boat, seat stability and robustness is important in an exercise machine. In one embodiment, the lower wheel set (240) in FIG. 2B is spring loaded so as to create a small amount of downward force to hold the upper wheels against the track at all times. Thus tipping forces, usually when the user produces maximum pushing effort with the legs at the beginning of a stroke, are countered in part without limiting the freedom of motion along the rail.

In one embodiment, ancillary components such as stirrups for the user's feet is provided and/or a stabilizing mechanism to hold the bench in a fixed position relative to the appliance (100) in FIG. 1A/1B is provided.

Figure 3A:
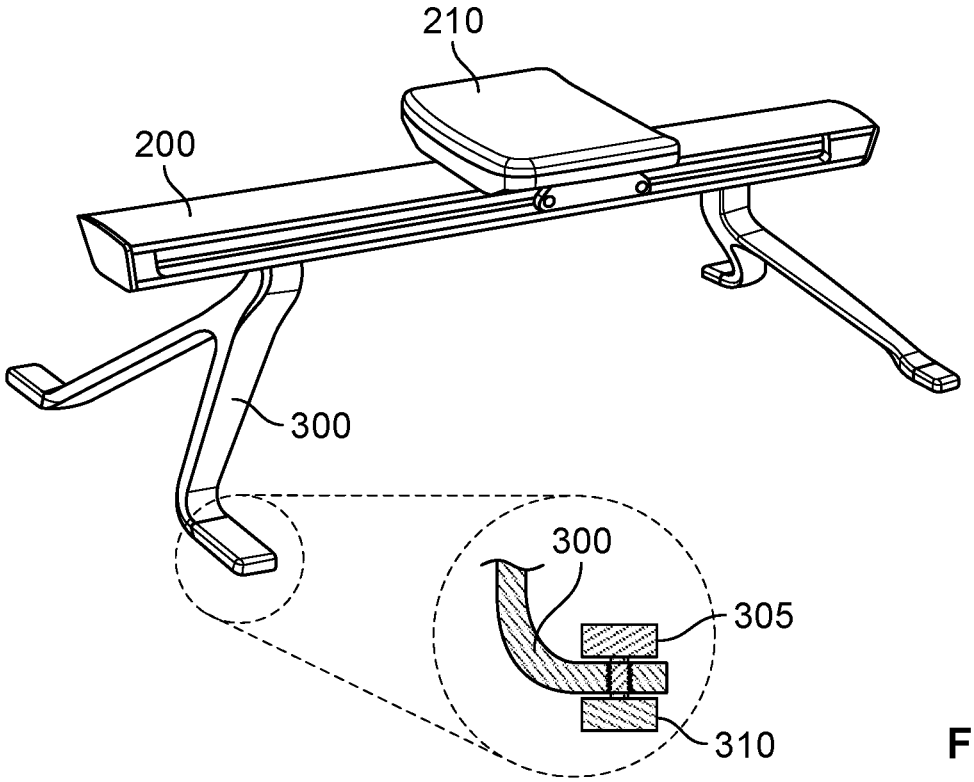
FIG. 3A is an isometric illustration of an embodiment of a user support unit configured as a rowing machine seat.

FIG. 3A is an isometric illustration of an embodiment of a user support unit configured as a rowing machine seat. The frame rail of the bench (200) is supported at either end by legs (300). To compensate for uneven flooring where the bench (200) is located for use, adjustable feet are used to level the bench (200). In one embodiment, this comprises a screw with a knurled or high friction surface on the head of the screw (305) so as to make it easy to grip by hand and a lower pad (310) that may be screwed or snapped onto the opposite end of the screw. The screw is inserted in a matching tapped hole in the lower end of each leg (300) and a thread form is chosen so that, when loaded, there is significant friction that prevents the screw from moving. One example of this may be an Acme thread or a trapezoidal thread-form which is typically found in applications such as lead screws on power tools or on a vise.

In one embodiment, the lower pad is made of a hard plastic, such as nylon, that is reasonably hard wearing. In one embodiment, the adjustable foot element is a single part that is screwed into the leg directly. Seat (210) traverses the bench rail that spans between the two supporting components (300) and is borne on wheels as shown in FIG. 2A and FIG. 2B. In one embodiment, to aid in leveling the bench assembly bubble levels are fitted that simplify this task.

One part of a successful exercise regimen is consistency. In single purpose appliances such as a dedicated weight machine and/or a rowing machine, mechanisms are installed so as to maintain a fixed spatial relationship. By contrast, in multi-purpose appliances where components are intended to have different spatial relationships, there is a need for repeatable positioning. For example, if a user applies forces against loads developed by an appliance, inaccuracies in positioning means that the force directions may be compromised.

Devices which rely only on gravity, such as free weights, are relatively free from this problem as the user balances the load in the same downward direction as the user experiences directly. However, when a user raises a constrained weight, either directly or using a load transfer mechanism such as a pulley and cable, then the angle at which the load is exerted may be unfavorable, to the point of risking serious injury.

Since the reconfigurable bench (200) has multiple uses, then in at least the rowing machine configuration, provision is made to accurately and repeatedly set the bench (200) in relationship to the loading appliance (100) in FIG. 1A/1B and to be able to direct the forces that the user applies to the load to both replicate the exercise intended, so that it matches the real experience of rowing and to ensure the user's safety from injury.

Figure 3B:
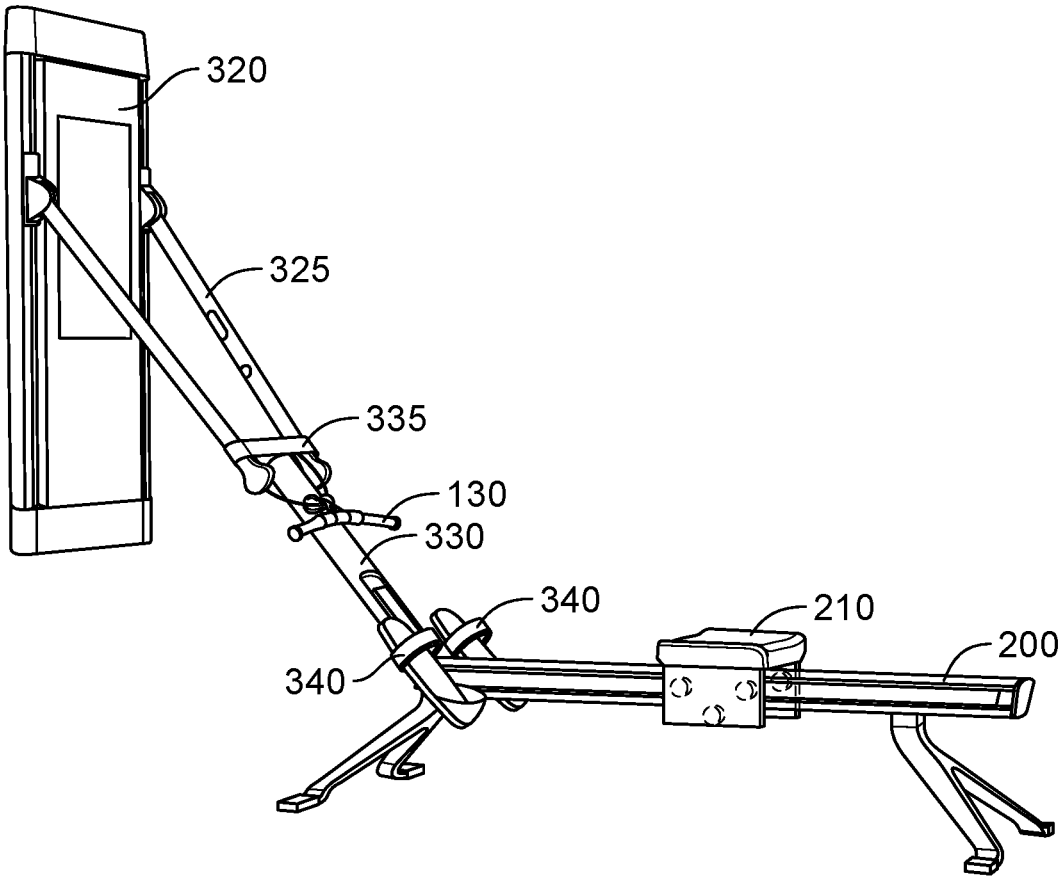
FIG. 3B is an isometric illustration of an embodiment of a secured user support unit.

FIG. 3B is an isometric illustration of an embodiment of a secured user support unit. As shown in FIG. 3B, the bench (200) is secured to the loading arms (325) of the exercise machine (320), or (100) in FIGS. 1A/1B. A connecting component (330) is attached to the bench (200) at the lower end of the component using, for example, a pin or pins for quickly changing the configuration of the bench. This connecting component (330) may be made of metal or a suitable composite material having the required strength and stiffness. An example of a composite material having an acceptable cosmetic appearance is a resin reinforced carbon fiber or similar. At the upper end of this coupling component (330) is a suitable attaching mechanism (335) that allows the arms (325) of the exercise appliance (320) to be secured.

Once the bench (200) is coupled in this manner to the exercise appliance (320), then the combination has a more fixed spatial relationship. Stirrups (340) along with a suitably surfaced foot plate may be incorporated in the coupling component (330) or may be installed as a separate component. A user grip (130) is coupled to the exercise appliance cables in either of the styles illustrated in FIGS. 1C/1D.

The user displaces the seat (210) along some or all of the length of the bench using foot pressure against the foot plate or plates. The user recovers the seat to the forward position on the bench using a combination of stirrup force, where the legs pull against the foot restraint, and any recovery loading of the exercise appliance (320).

In physical rowing, forward movement is predominantly caused by the user's legs pulling against the foot restraints, because the oars are raised from the water so that they may be moved to the new entry position in the water prior to beginning the next power stroke. In an exercise simulation, because the exercise appliance (320) may develop loads using cables which only transmit loading under tension, the appliance creates sufficient load to retract the cables to the starting position without allowing the cables to become slack.

To operate effectively, one exercise profile assumes that the user is operating so as to match the forces that would be experienced as an oar enters the water. The load experienced by the user is then developed as a smoothly increasing load ramp to the level demanded by the exercise program being used. This load is then held close to this value to simulate the power stroke experience of a competitive rowing boat and as the user reaches the stroke limit, diminishes to a minimal retraction load using a smooth ramp down. Where the exercise appliance (320) is programmable, nearly any loading profiles may be developed to suit a user's needs, limited only by the need for the load carrying cable to remain in tension.

Figure 4A:
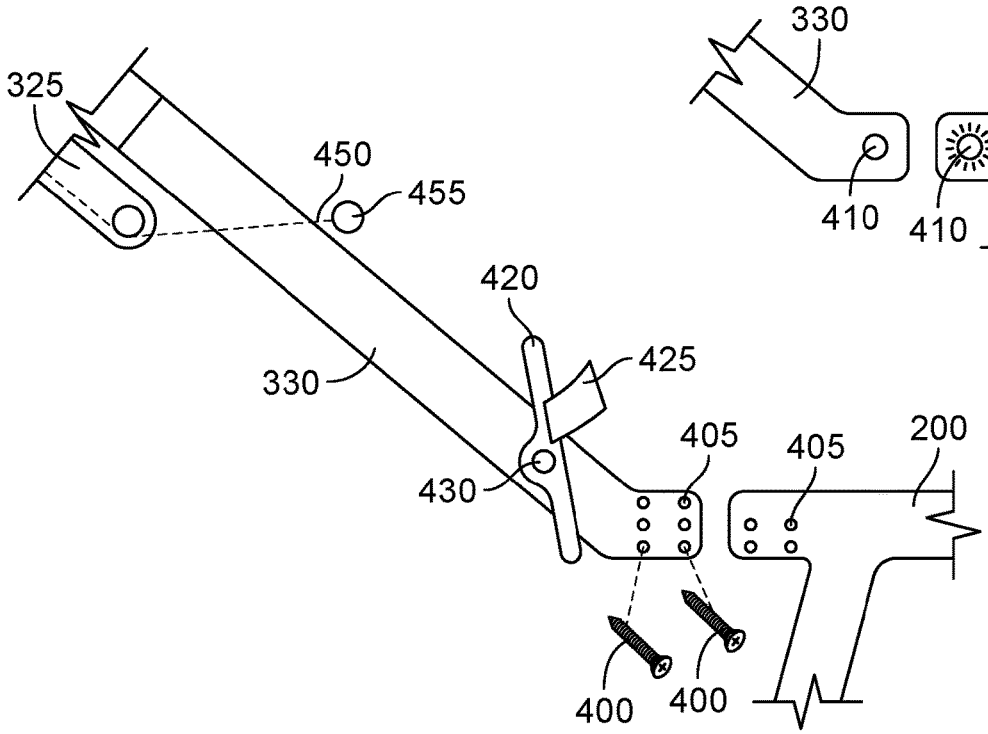
FIGS. 4A, 4B, and 4C illustrate an embodiment of a coupling component in different views.
Figure 4B:
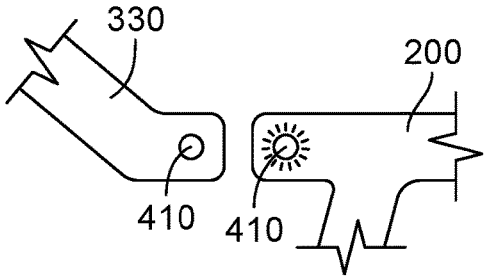
Figure 4C:
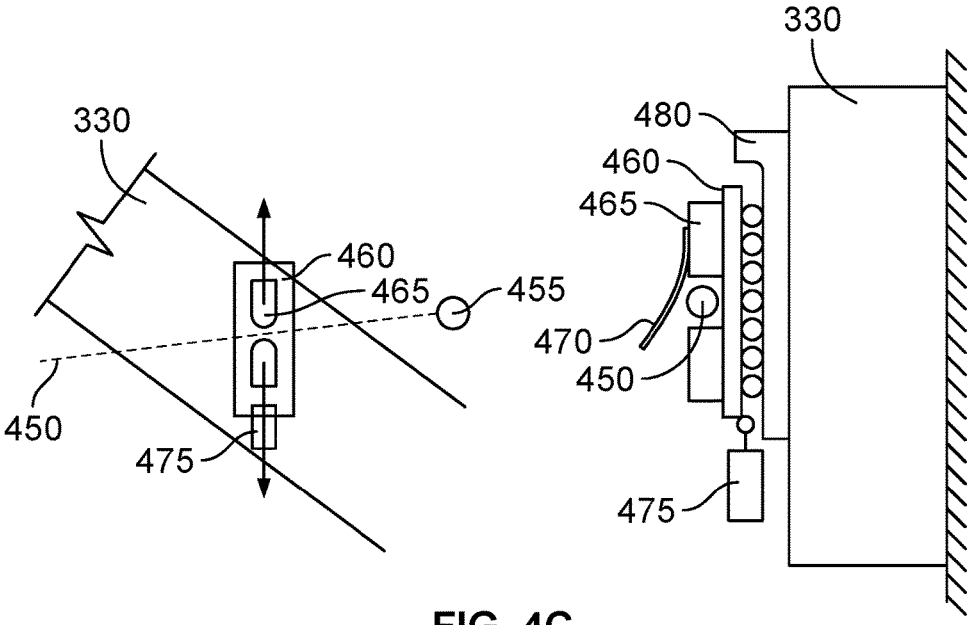

FIGS. 4A, 4B, and 4C illustrate an embodiment of a coupling component in different views. As shown in FIG. 3B and in partial-exploding diagram in FIG. 4A, the point at which coupling component (330) attaches to bench (200) is a point where adjustment may be made so that the upper point where coupling component (330) meets adjustable arms (325) of the exercise machine (320) may be established. In one embodiment, the detachable coupling component (330) is fixed, using pins to secure it in a predetermined orientation, and the bench is moved until it contacts the arms (325) of the exercise machine (320).

In one embodiment, a detachable coupling component (330) may be fitted in any of a number of predetermined locations using pins (400) and a series of matching holes (405) which allows the distance of the bench from the exercise appliance to be varied to accommodate users of different build.

FIG. 4B shows a system that allows the coupling component (330) to be rotated in small discrete steps using mating, toothed surfaces (410) to set position. Here, a single screw or bolt tightens the mating toothed surfaces together so that the position of the coupling component is fixed in the selected position. This is useful for users having longer trunk dimensions since it allows the machine arms (325) to be raised to their next predetermined position to match the increased shoulder height of the taller user.

Each footplate (420) in FIG. 4A has a stirrup (425) that forms a surface for the user to push against during the power stroke as the seat is displaced along with a retaining element for the user's foot to pull against on the return stroke. The assembly may be angled for comfort using bolt (430) along with a locking mechanism to adjust it. In one embodiment, a series of holes is provided so that the vertical position of the pedal may be altered; these adjusting holes may be in the foot pedal itself, in the coupling component (330), or both.

As shown in FIG. 4A, the load is developed in the cable (450) from each of the two arms. This cable passes over a pulley-style device at the end of the arm so that there is a significant amount of angular displacement possible with relatively constant loading. A coupling (455) at the cable end allows the attachment of a range of different styles of user grip to be accommodated, depending upon the exercise application intended. For the rowing application, a simple handlebar grip (130) or (140) as shown in FIG. 1C or FIG. 1D may be used.

During the sequence of actions whilst rowing, a user does more than merely displace the oars against the load. The hands and arms describe an approximately elliptical motion as the oars are lowered into the water at the start of the stroke and then raised from the water towards the end of the stroke. Although the basic exercise may be performed without regard to this displacement if only the aerobic activity is sought, as a serious training aid it is much improved if the elliptical action may be measured and thus the form of the user managed.

FIG. 4C illustrates an embodiment in which a sensor arrangement may be used to monitor this. For practical purposes, the cable under tension may be assumed to be straight; the catenary effect that causes drooping is nearly negligible over the short lengths involved and may be calibrated to remove that as an error source.

The load cable (450) is passed between two blocks that are attached to a slide comprising a moving side (460) and a non-moving side (480). A slide uses ball bearings to minimize friction between these two parts. The non-moving side is attached to the coupling component (330) proximate to the resting position of the cable (450). A simple spring retainer (470) may be used to prevent the cable from disengaging from its position between the blocks whilst permitting easy, deliberate removal.

A position transducer (475) is used to determine the position of the moving part of the slide, which position changes as the angle that the cable (450) makes with the centerline of the exercise machine arm (325) changes in response to the user raising or lowering his or her arms as the oar positions are mimicked.

Although this movement is angularly small, it is repeatable and provides a strong indicator of user tiredness; as fatigue sets in, the user's ability to maintain the vertical displacement of the oar (in this case, the user grip that simulates the oar) declines and so the angular shift diminishes in a direct relationship. The timing of this exertion as a user attempts to compensate provides valuable information that may be used to alter the machine loading so as to build stamina during the training cycles.

In one embodiment, the angular sensor is built into the exercise machine arm at the pulley spindle support and lateral force is measured orthogonal to the centerline of the arm. From this the cable deflection may be computed, since the tension is known at all times; measuring a force component F orthogonally means that the cable tension in the arm has no component in this direction and so the only component (which may be measured directly using a force transducer) comes from the deflected cable in the amount of the cable tension T (set by the appliance itself) multiplied by the sine of the angle a (which may be computed) that the cable is deflected from the line made by the cable within the arm-angle $\alpha$=arcsin (F/T).

The majority of the work done while rowing is performed by the large muscles in the legs, supplemented by the muscles in the lower back, so one improvement is measuring not simply as a total, but as a combination of elements. To measure the leg extension the position of the seat may be tracked and from this both velocity and acceleration may be calculated. Measurement of the effort exerted by the back muscles in combination with the arms may be derived from determining the extension of the cable, corrected for the angular change as the user grip position is altered, and then considering the seat position.

For example, if the seat has come to rest and the cable is still being pulled by the user, it may be inferred that the back and arms are in motion. Similarly, if the seat is accelerating from the point at which the cable extension is least, it is likely that the legs are starting the power stroke while the back and arms contribute relatively little. Differences between seat motion due to user operation and cable motion due to changes in user posture provides additional information that may be used in algorithms that measure and optimize the exercise parameters that may be applied to the user's exercise session as well as adjusting other training exercises to help maximize the user's strength distribution.

The evolution of modern sensor technologies, coupled with a focus on low cost, low power consumption and wireless connectivity, permits installation of a wide variety of sensors to collect data without power supply concerns. MEMs type sensors are able to measure tiny accelerations and changes while inductive or capacitive sensors are able to sense position as well as rate of change of position.

Because the operation of a sliding seat in a high energy activity such as a rowing exercise displays significant acceleration changes, a small portion of this energy may be reclaimed using energy harvesting techniques and this recovered energy may then be stored as electrical charge to provide power for sensors that are embedded in the seat. This is an improvement because it alleviates the need for any user intervention to change batteries or perform routine maintenance. Additionally, most exercises are performed under good lighting conditions so small solar cells, such as those used for calculators, may be embedded at the seat assembly and used to provide another source of charge.

Without limitation, sensor fusion using the above sensors and/or other sensors such as a camera, a depth sensing camera, a seat sensor, a push force sensor for a user foot, a magnetometer, an accelerometer, a load cell, a pull force sensor for a user foot, a seat to rail position sensor, a cable positions sensor, and/or a handle sensor, is disclosed. This sensor fusion improves the user training by providing form feedback and/or health metrics.

Figure 5:
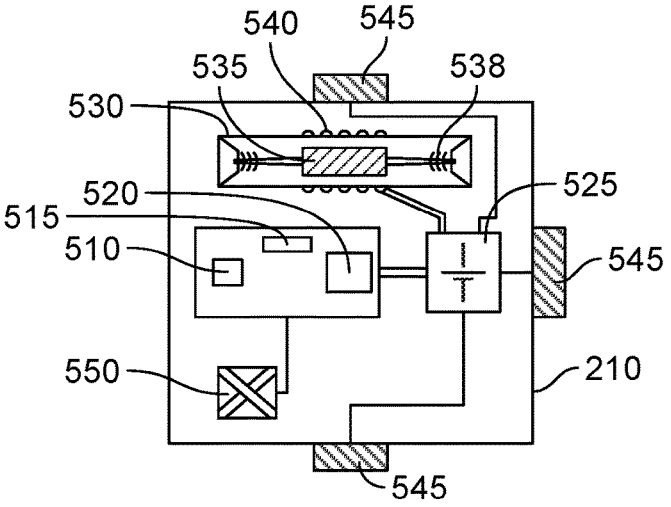
FIG. 5 illustrates an embodiment of a sensor system embedded in a seat structure.

FIG. 5 illustrates an embodiment of a sensor system embedded in a seat structure. The seat (210) comprises a mechanical structure to which is attached the mechanism to allow low friction translation of the seat along the rail that forms part of the bench frame and that provides a protected space for the instrumentation that is installed to monitor seat dynamics as well as a platform upon which an upholstered part for the user to sit on may be secured.

The system illustrated in FIG. 5 has an acceleration sensor (510) coupled to a processor/microcontroller (515) to a radio transceiver (520). Power is provided by, for example, a battery system (525) that is charged by an energy harvesting component (530) or by an array of small solar cells (545). Position is determined by a position sensor (550) which may be one of several types discussed below, which is coupled to the microcontroller (515).

The accelerometer (510) provides acceleration information in at least the direction that the seat traverses during exercise. Since modern integrated accelerometers are manufactured to have two or three accelerometer elements that are mutually orthogonal to a high degree of accuracy, placement accuracy of the sensor along the intended axis or axes may be coarse and the data processed computationally to extract the acceleration along any arbitrary axis; a simple calibration involves pushing the seat along its axis of travel and resolving the vector summation of the two or three accelerometers that report activity. During initialization, offsets due to variations in gravitational field when the appliance is used in different locations, and that may cause errors, are zeroed algorithmically.

The processor (515) may be selected for low power consumption operation, commensurate with the intended tasks that it needs to perform to ensure system operation. Ideally the processor should be able to sleep for long periods to keep power consumption to a minimum during periods of disuse. In use, the processor accumulates information from various sensors coupled to it, performs any calculations or algorithms using the information and then sends this processed information to a wireless system (520), from where information may be provided to other appliances, such as the exercise machine (320) that generates the loads for the user to exercise against. In one embodiment, a wired system instead of wireless system (520) is used.

The radio system may use any of a number of protocols, such as Bluetooth®, WiFi, ZigBee® and operated at approved frequencies. Other protocols and/or devices may be used in the U.S. that use Chapter 47 of the Code of Federal Regulations, Part 15, in the Industrial, Scientific and Medical bands. The radio link (520) may be bi-directional, so the processor may also receive and interact with other information via this link.

In one embodiment, a battery system (525) provides power for the system. In one embodiment, a primary battery such as a lithium coin cell may be used, and although the battery lifetime may be long, provision may be made to allow a user to replace this part eventually. Another embodiment is to use a rechargeable cell and then provide a means to recharge it.

In one embodiment, an energy harvesting system comprising a moving magnet generator (530) is used to recharge. The generator (530) is aligned along the fore-aft axis of the seat. A solenoid (540) is wound around a tube of circular cross-section and connected to a rectifier assembly contained within the battery pack (525). A magnet (535) having a circular cross section and north and south poles at opposite ends of the magnet is set inside the generator tube and should be a loose, low friction fit; if necessary, the inside of the tube may have ridges to hold the magnet centrally in the tube and that allow the air to pass easily so that as the magnet is moved, there is no restriction due to air pressure build-up. Soft bumpers (538) or a light spring may be installed to close off the tube at either end and to reduce the noise that occurs if the magnet strikes the ends of the tube.

In use, when the seat is accelerated, inertia causes the magnet to remain stationary, while the tube, which is embedded in the seat assembly, moves with the seat until the magnet strikes the end buffer, whereupon the magnet now moves with the seat. When the seat is decelerated and direction reversed, the magnet moves in the opposite direction until it reaches the opposite end stop. This oscillation of the magnet, in sympathy with motion of the seat, causes a current to flow in the coil (540) wound around the outside of the tube. A rectifier in the battery pack (525) allows this current to flow by connecting it appropriately to the battery and thus charging it.

In one embodiment, a supercapacitor and/or ultracapacitor is used to store charge instead, and a voltage regulator system limits the voltage that may be produced if the charging rate exceeds the consumption so as to continue to build voltage. In another implementation, small solar cells (545) are installed at point around the seat so that ambient light may be used to charge or recharge the cell or cells in the battery pack.

The processor detects the change in voltage when the energy harvesting component begins to transfer charge and this is used to bring the system to the operating mode. When motion ceases, after a predetermined time period the processor disconnects the radio link and enters a sleep mode to reduce power consumption to a bare minimum.

In one embodiment, a position sensor (550) provides position information to the processor. There are several ways that this function may be achieved but, if there are a number of users, it is important to understand that a fixed setting is unlikely to be sufficient; that is to say the position sensing has to be automatically self-adjusting and fixed end points may not be sufficient. Further, using simple friction contact methods to encode position, as the environment local to an exercising user may be humid, may slip and develop errors, so that the disclosed techniques are improvements.

Figure 6A:
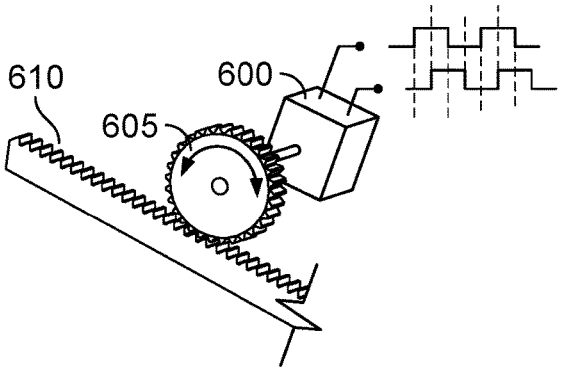
FIG. 6A illustrates an embodiment of positive contact using a toothed track.

FIG. 6A illustrates an embodiment of positive contact using a toothed track. This is a practical approach for illustrative purposes. In this case, an encoder (600) has a gear wheel (605) that engages with the track (610) and produces quadrature pulses that indicate not simply the number of pulses, corresponding to distance travelled, but the direction as well. In this way the points that define position as well as the points at which motion is reversed may be easily identified.

Speed is directly available from this kind of system based upon the time between pulses or their duration. To improve the operation of a toothed track system, the teeth may be oriented horizontally and the encoder shaft mounted vertically which reduces the accumulation of debris. A spring loading mechanism may be used to ensure positive engagement between the gear wheel and the track.

Figure 6B:
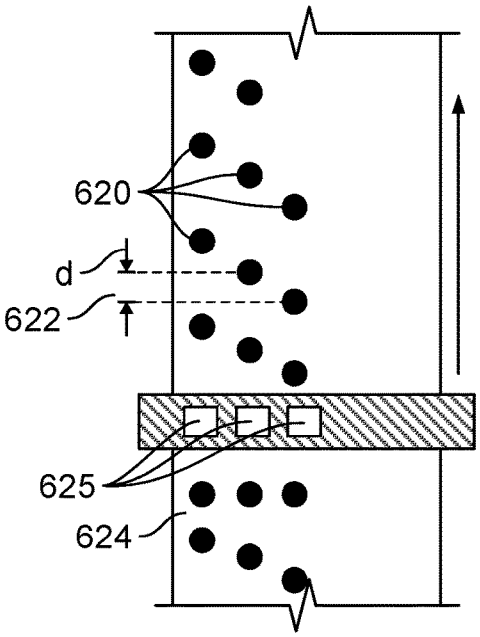
FIG. 6B is an illustration of an embodiment using magnets.

FIG. 6B is an illustration of an embodiment using magnets, where in FIG. 6B a section of the rail upon which the seat moves is shown. A series of magnets (620) is embedded into the track in a diagonal pattern set in three rows so that the distance (622) d between a magnet in one row and a magnet in another row is fixed, except for a point where three magnets (624) lie in a line. A complimentary set of three detectors (625) is affixed to the seat assembly so that each detector tracks a single row of magnets. These detectors (625) indicate the presence or absence of a magnet and may be any proximity detector. When the detectors are all activated, this indicates that the seat is located at the in-line row (624).

As the seat moves, the detectors switch off and then switch on as each passes a magnet beneath it in a repeating sequence. By counting the number of pulses, the distance moved from the reference row (624) may be accurately determined; if the right hand detector switches on first, then the seat has moved in the forward direction (shown as an arrow in the illustration) by a distance d and when the second (middle) detector switches it has moved a distance 2d and so on. Inspection of the switching sequence indicates the direction of movement.

In one embodiment, the detectors have a bias magnet fitted which allows them to detect the absence of magnetic material. Using the same basic pattern, instead of installing magnets into the rail, holes are drilled and the detectors now indicate the transition from a magnetic material to a non-magnetic segment where the hole removes some of the magnetic material of the rail. Because this requires the presence of magnetic material, it is well suited to a bench that uses steel construction.

The same effect may be achieved with an aluminum construction by attaching a sheet of thin steel to the surface of the rail where sensing is required and the sheet may be pre-punched with the required pattern of holes. As is clear to one ordinarily skilled in the art, there are several ways to create a magnetic profile desired.

To improve the cosmetic appearance of the bench, holes may be filled with a non-magnetic material such as an epoxy and the entire part painted with a suitable coating. This method has the improvement that it is entirely non-contact, uses highly reliable sensors most commonly found in demanding automotive applications and permits the entire sensing system to be enclosed within the confines of the seat assembly. Systems using infra-red light and optical encoding are also practical solutions without limitation.

Determination of the user's posture may be approximated by a combined analysis of the dynamic information collected by both the seat and the exercise appliance that creates the load against which the user exercises. One valuable component that improves the quality of the analysis is the location of the user's center of gravity. To achieve this, the load on each of the supporting legs of the exercise bench may be measured.

As the user moves the seat during exercise, weight transfer occurs from the front legs to the rear legs as the seat is pushed back and vice versa when it is drawn forward. Because this is a bench and position remains fixed for the duration of the exercise period, if the weight of the user is known, the load measurement may be simplified and treated as a seesaw problem. The front legs are placed directly on the floor and act as a pivot point, while the load is measured on the rear legs.

The distance of the seat from the front legs (the pivot) is known because the position is sensed directly, for example using a sensor, and so the user's center of gravity may be determined by the balance equation and the load sustained at the rear legs. In one embodiment, the distance may instead be controlled by locking pieces together and/or placing something of a fixed distance between. Since the seat position is known, the position of the user's center of gravity relative to the seat may be determined. The user's position relative to the resistance device and an arm may be determined as well.

From this information the user's posture may be inferred, which may then be used by the exercise appliance that generates the load against which the user exercises. The user may receive instruction or coaching as part of the acoustic data dispensed by the exercise machine and this may be modified so as to alter the user's posture. Position and posture are two separate points of feedback for coaching.

If the user weight is not known, then the load sensing may occur at all four legs of the bench and the user center of gravity determined directly from this information and/or the user weight is determined using one or more load cells.

Figure 7A:
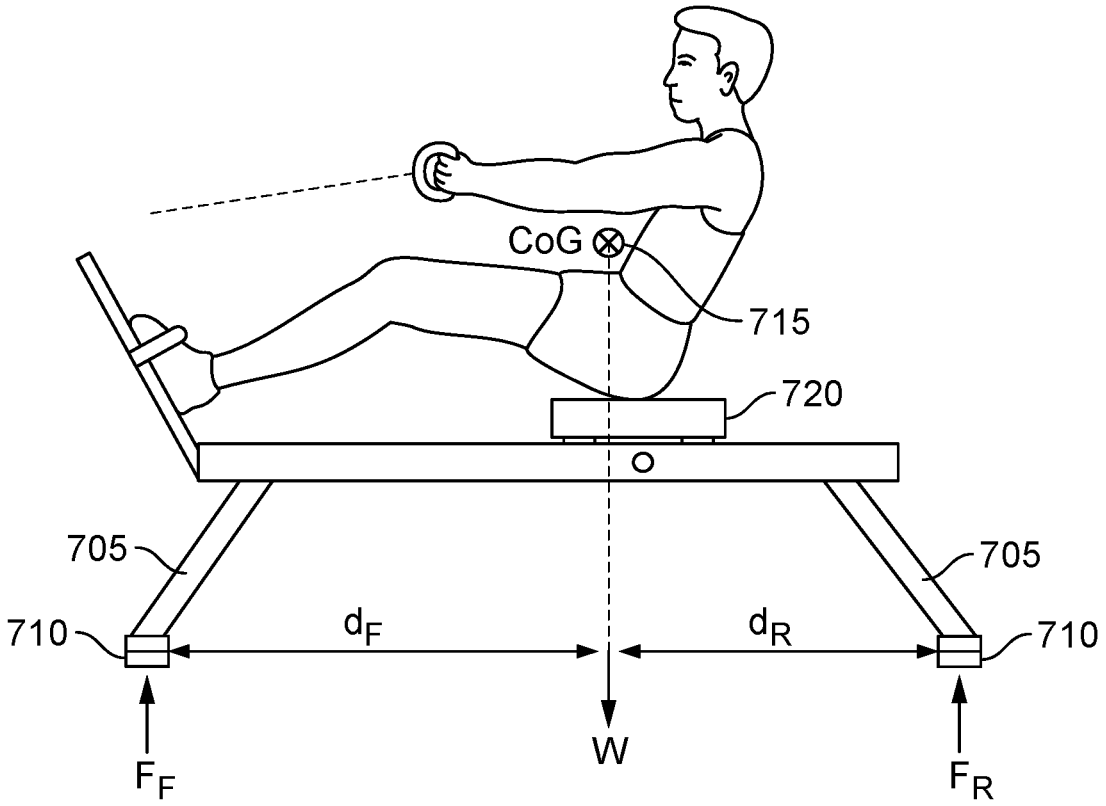
FIG. 7A illustrates an embodiment of instrumentation of a bench frame.

FIG. 7A illustrates an embodiment of instrumentation of a bench frame. Load cells (710) are affixed to each of the bench feet (705) and for each end of the bench, the sum of the two load cells is the force at that end. A processor monitors the load cell signals and filters the noise before calculating the parameters that are sought.

For illustrative purposes, FIG. 7A shows only two legs and two load cells and the forces are designated FF and FR as the front and rear forces respectively. The sum of these two forces equals the weight of the user (the weight of the bench may be removed from the calculation via a "tare weight"). Using the principle of moments, FF×dF=FR×dR and dF+dR is the distance between the load cells and is constant. What is thus sensed is a measured weight and the location of the user's center of gravity.

Notice that the seat (720) is not considered here, but its position relative to the center of gravity of the user may be used in a subsequent analysis. The detail of connection of the load cells and the power system for the processor is omitted from FIG. 7A since this is very similar to that already described for the seat.

Figure 7B:
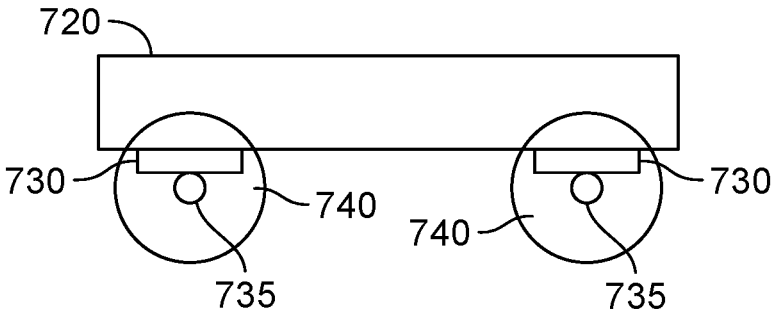
FIG. 7B is an illustration of an alternate embodiment of instrumentation in a bench frame.

FIG. 7B is an illustration of an alternate embodiment of instrumentation in a bench frame. In FIG. 7B, the seat is equipped with load sensors (730) at each of the four wheels (740) that allow it to slide on the rail of the bench. Typically, the load cells (730) are a part of the axle (735) assembly for ease of manufacturing. Because the user's trunk is predominantly the moving mass that is supported by the seat (720), this offers a more reliable estimate of posture. The load cells (730) are coupled to the processor (515) that is already used for determination of the seat dynamics of position and acceleration and has the advantage that all of the instrumentation is now contained in the seat platform and does not require any change to the bench frame.

In one embodiment, the above described bench is used with a different "dumb" traditional weight-stack and/or rail-based gravity-based exercise machine. In this case, the physical components of the bench operate as described above. As for embodiments of the bench that include sensors collecting data, and/or a processor processing the data, this data may be sent to an external computer, such as a mobile phone, for further processing.

Figure 8A:
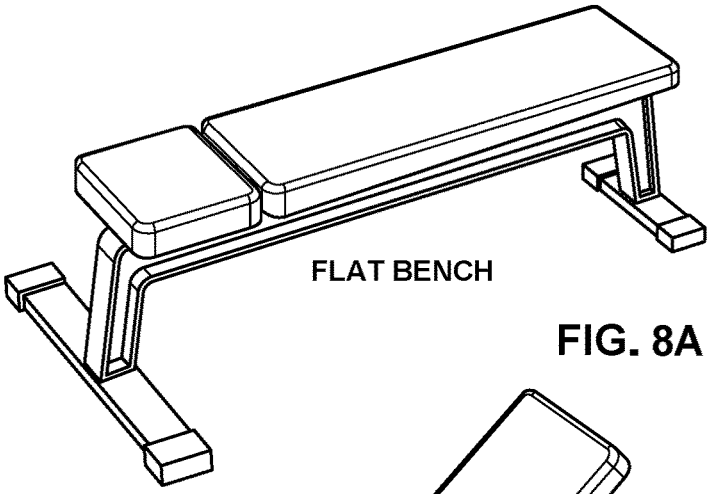
FIG. 8A shows a standard and/or flat bench configuration for the bench.
Figure 8B:
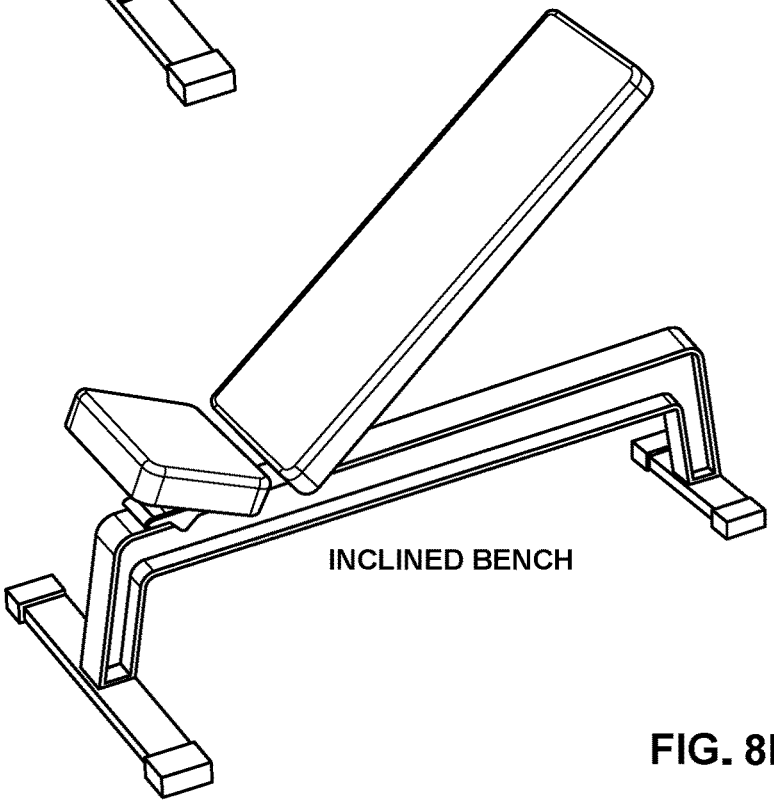
FIG. 8B shown an inclined bench configuration for the bench.
Figure 8C:
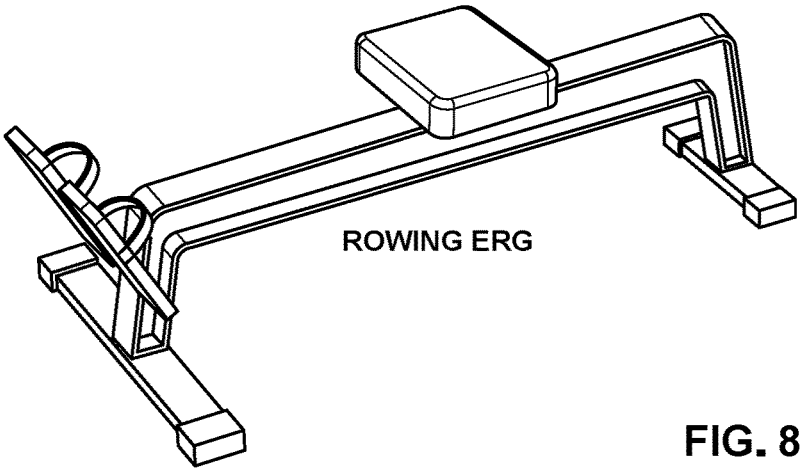
FIG. 8C shows a rowing ergometer configuration for the bench.

FIGS. 8A, 8B, and 8C illustrate in cartoon form an embodiment of a user support unit in three different configurations. FIG. 8A shows a standard and/or flat bench configuration for the bench. FIG. 8B shown an inclined bench configuration for the bench. FIG. 8C shows a rowing ergometer configuration for the bench.

Figure 9A:
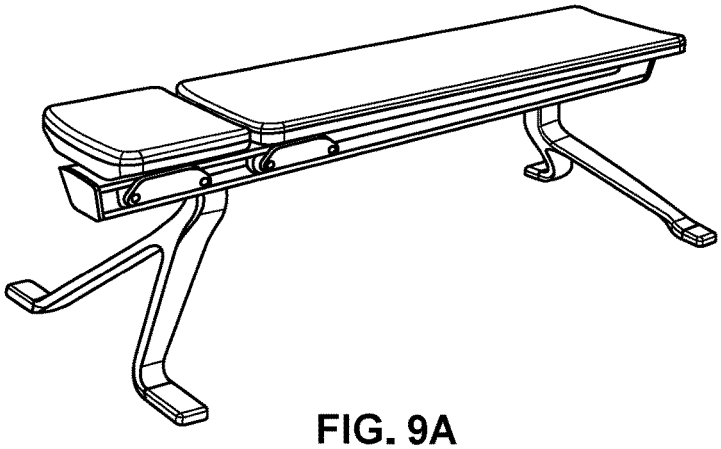
FIG. 9A shows a standard and/or flat bench configuration for the bench.
Figure 9B:
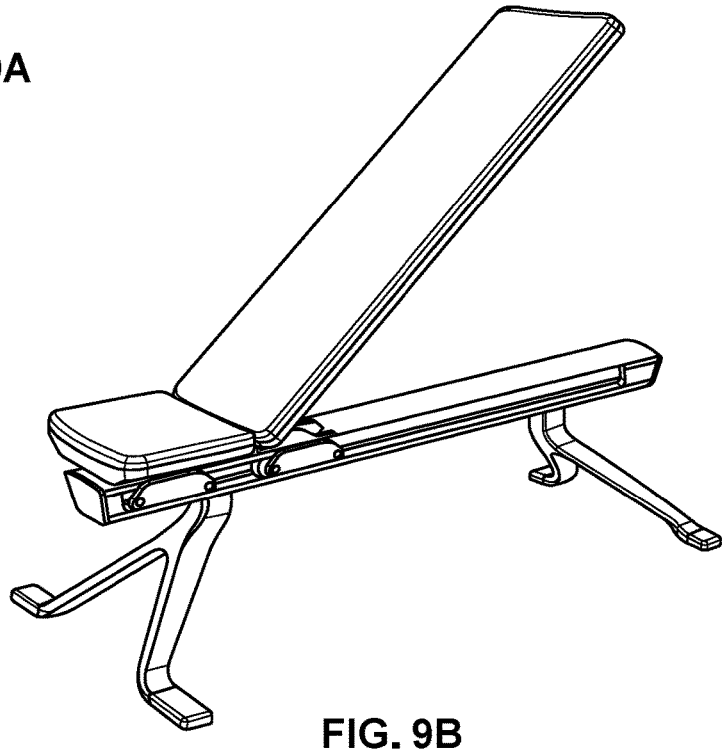
FIG. 9B shown an inclined bench configuration for the bench.
Figure 9C:
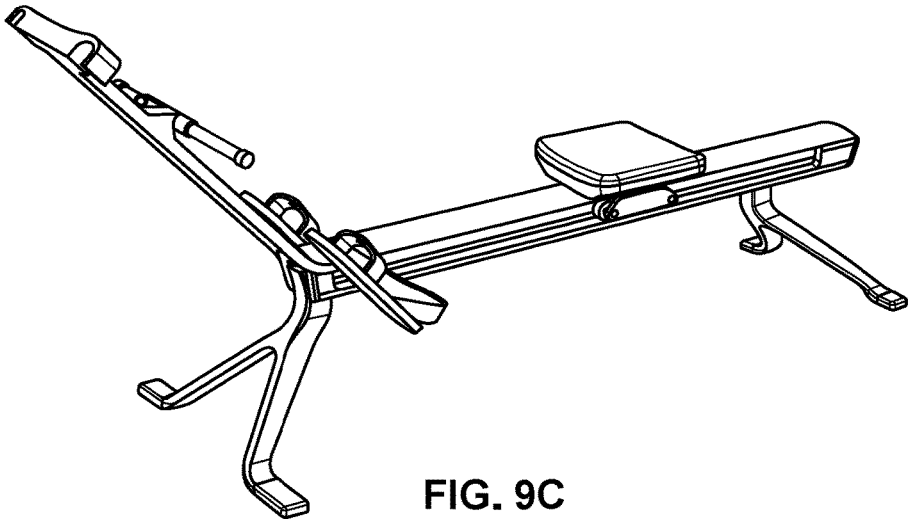
FIG. 9C shows a rowing ergometer configuration for the bench.
Figure 10:
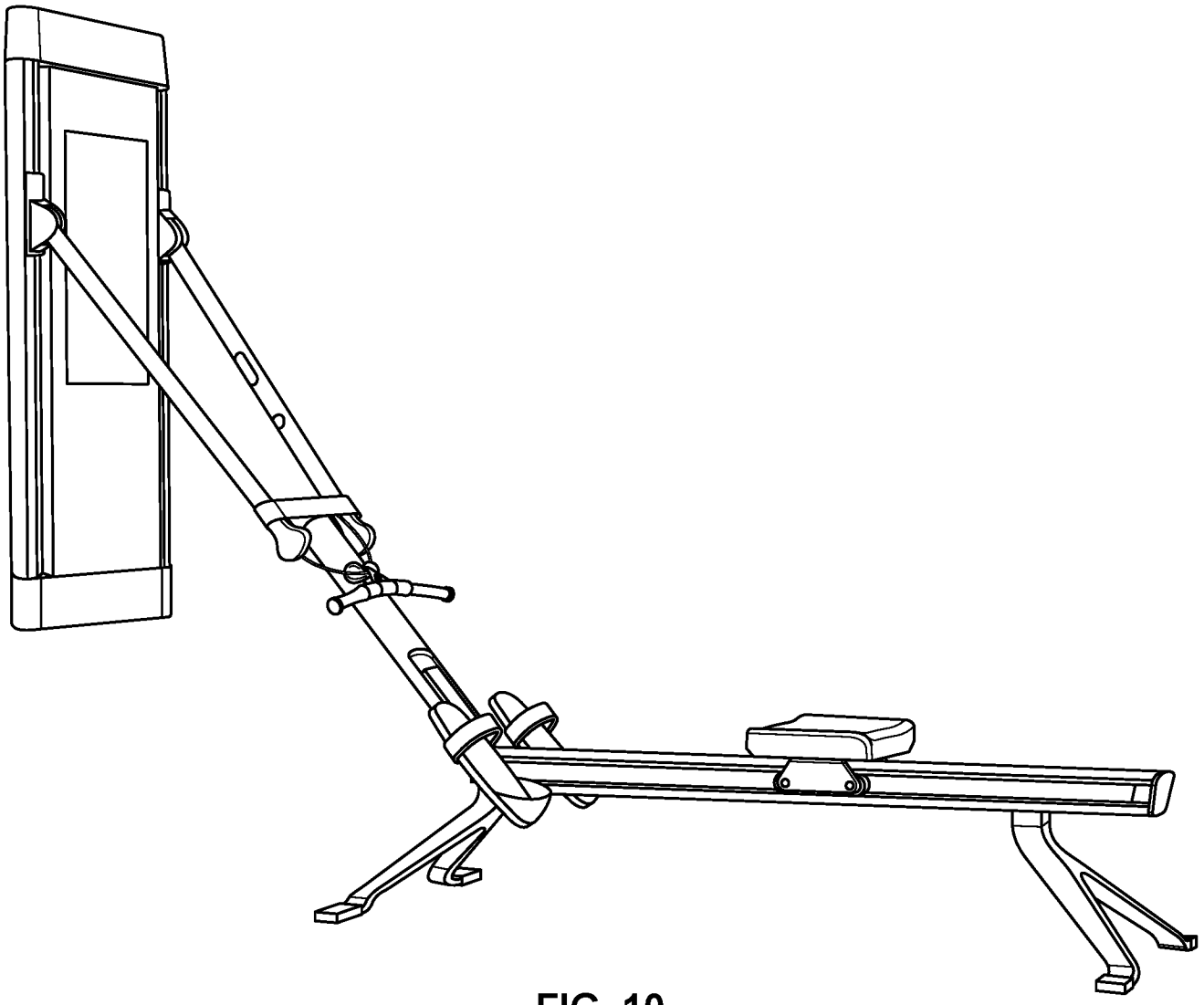
FIG. 10 illustrates an embodiment of a user support unit coupled to a wall-mounted exercise machine.

FIGS. 9A, 9B, and 9C illustrate an alternate embodiment of a user support unit in three different configurations. FIG. 9A shows a standard and/or flat bench configuration for the bench. FIG. 9B shown an inclined bench configuration for the bench. FIG. 9C shows a rowing ergometer configuration for the bench. One difference between FIGS. 9A, 9B, and 9C and FIGS. 8A, 8B, and 8C are angled legs for improved stability. FIG. 10 illustrates an embodiment of a user support unit coupled to a wall-mounted exercise machine, such as resistance unit (100) in FIGS. 1A/1B.

Figure 11A:
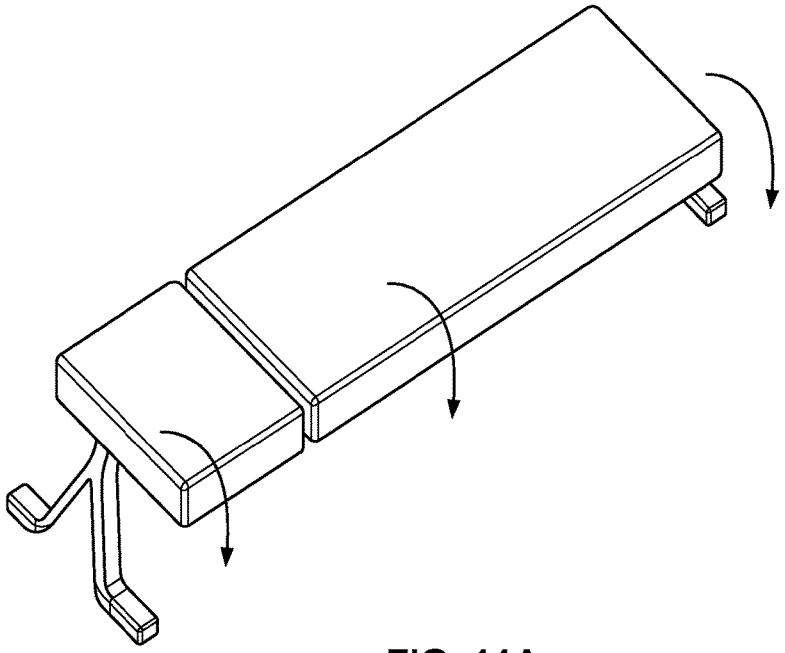
FIGS. 11A and 11B illustrate an embodiment of a rotating user support unit.
Figure 11B:
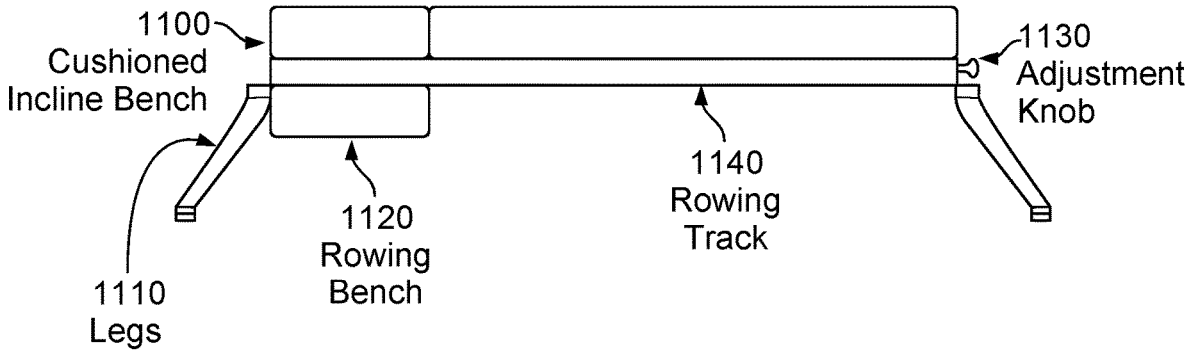

FIGS. 11A and 11B illustrate an embodiment of a rotating user support unit. As shown in FIGS. 11A/11B, the rowing track (1140) and rowing seat (1120) are on one side of the central support structure, and the bench (1100), which may be configured to incline, is on the opposite side. A mechanism (1130) to allow the bench to rotate is positioned at one end of the bench. Loosening the mechanism allows the bench to rotate, enabling the underside to face upwards for use.

Figure 12A:
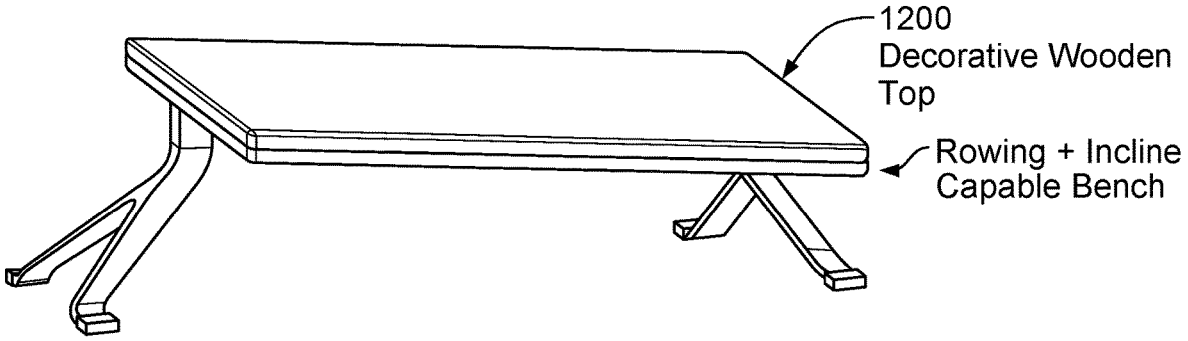
FIGS. 12A and 12B illustrate an embodiment of an adjusting user support unit.
Figure 12B:
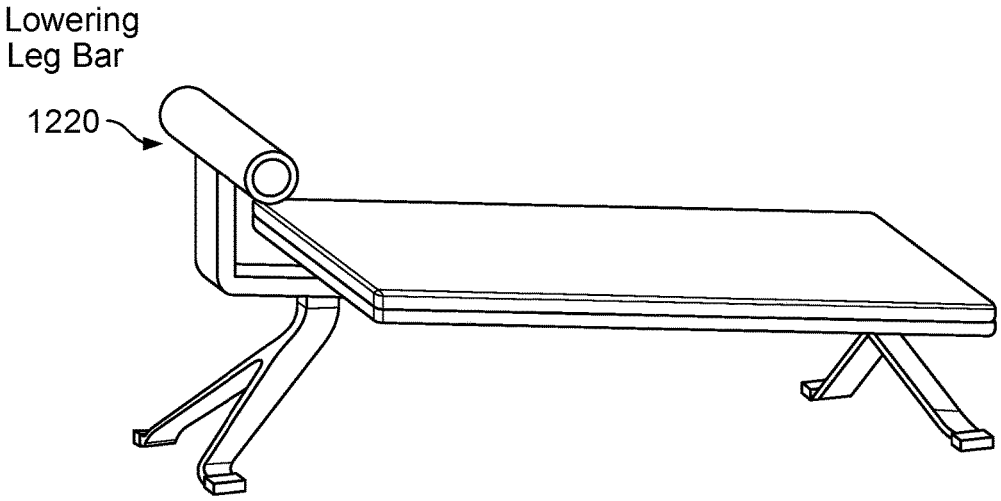

FIGS. 12A and 12B illustrate an embodiment of an adjusting user support unit. As shown in FIGS. 12A/12B, the rowing seat and incline-capable bench are on the same side, and an alternative function is on the opposite side. The user switches between which side is currently in use by using the same type of adjustment mechanism (1130) as shown in FIG. 11B. The opposite side as shown in FIGS. 12A/12B may comprise any of the following: (1) a decorative top made of wood (1200), as shown in FIG. 12A, steel or some other aesthetically pleasing material, for display purposes when the bench is not being used during exercise workouts; (2) the same functionality as the primary side (that is, with rowing seat and incline-capable bench) but with different materials so that the user could choose between stiffness, material, or color; (3) a different workout function, as shown in FIG. 12B, such as a bar (1220) used for leg raises, sit-ups, retaining the torso during lat pulldowns, and other exercise functions.

Figures 13A, 13B:
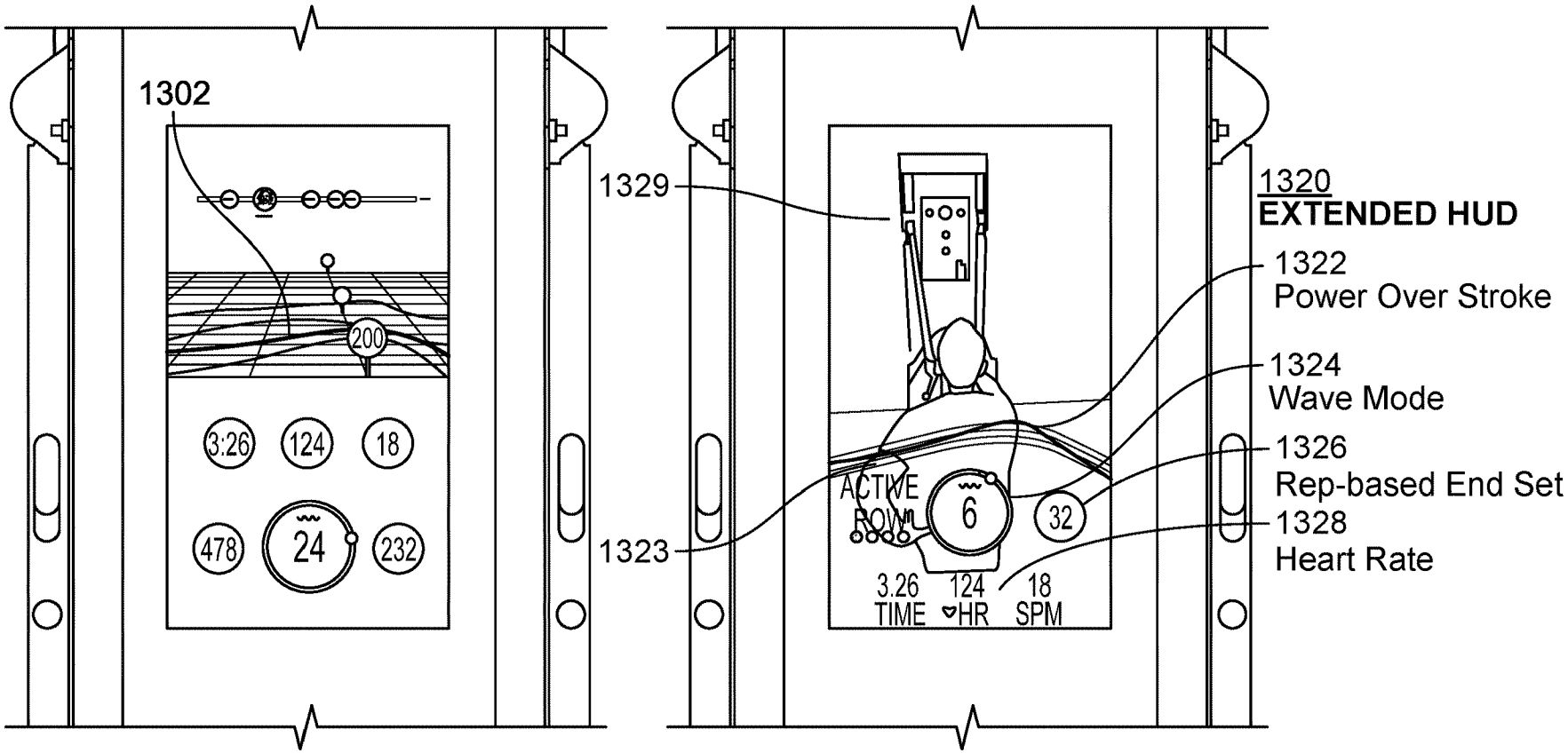
FIGS. 13A and 13B illustrate an embodiment of a screen.

FIGS. 13A and 13B illustrate an embodiment of a screen. In one embodiment, the screen of FIGS. 13A/13B is the screen (105) of FIGS. 1A/1B. In FIG. 13A, an example user interface for the screen includes an interface to indicate time, heart rate, rowing rate, watts exerted, repetitions per minute, and/or a curve (1302) showing power/performance over a rowing stroke. In FIG. 13B, a second example user interface, called an extended heads up display or "extended HUD" (1320), shows power over a stroke (1322) with a black target band (1323) indicating a stroke delivery target for a given user based at least in part on user information such as their skill level, age, sex, weight, and/or strength. A wave mode (1324) may indicate that a fluidic resistance is being simulated by the motor (102) of FIG. 1A, and that additional elements such as currents, wind, and/or waves may also be simulated. Wave mode (1324) may also indicate whether a user is in a power stroke or recovery stroke during rowing. Other information in the extended HUD (1320) may include a repetition (or "rep") counter (1326) and heart rate monitor (1328). An extended HUD (1320) may also include images/video from one or more cameras (1329) that show the user, teammate, or a coach performing rowing in synchronization, rowing out of synchronization, a simulation of a rowing environment, and/or other displays or discussion.

Figure 14:
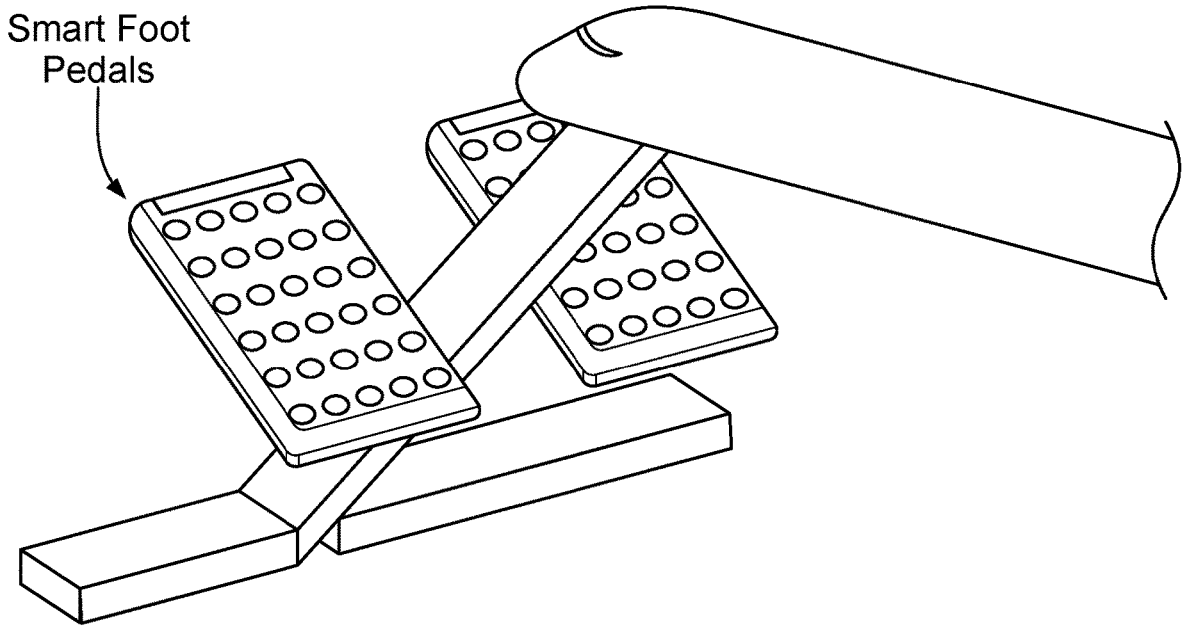
FIG. 14 illustrates an embodiment of smart foot pedals.

FIG. 14 illustrates an embodiment of smart foot pedals. By integrating a sensor array into the foot pedals, the sensor fusion described in FIGS. 4A/4B/4C/5 is improved by sensing where and what pressure is being exerted across the pedal relative to the feet of the user. For example, smart foot pedals may be able to detect whether a user is in a power stroke or a recovery stroke, and/or detect whether a user is using a proper form during a rowing stroke.

Figure 15A:
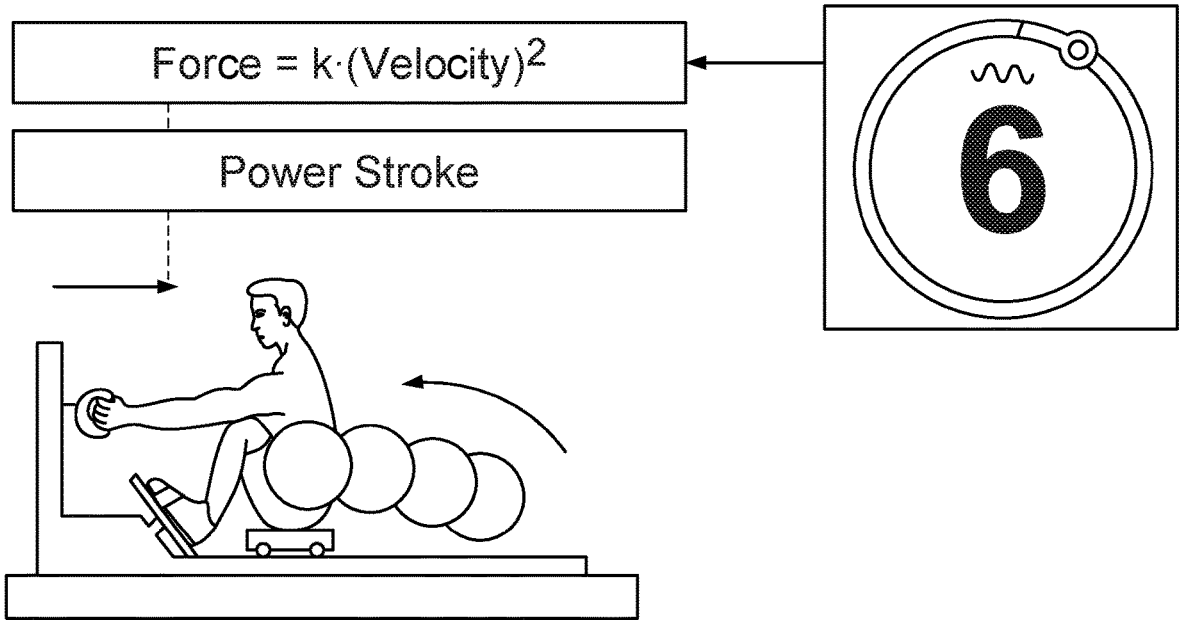
FIG. 15A illustrates an embodiment of power stroke calculations.
Figure 15B:
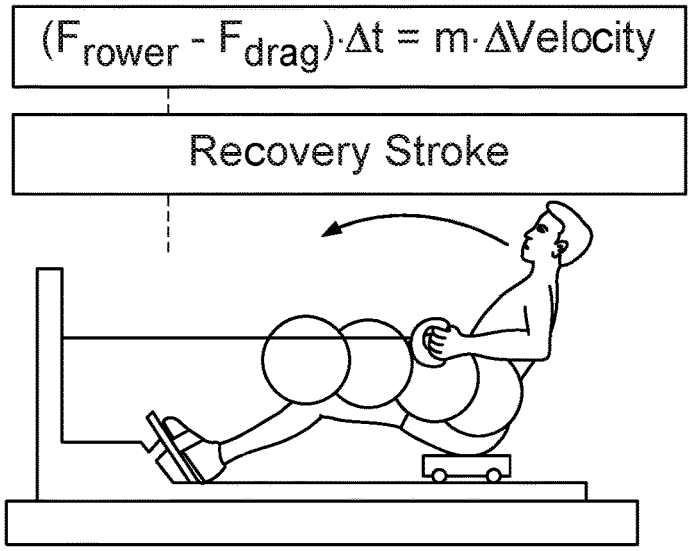
FIG. 15B illustrates an embodiment of recovery stroke calculations.

FIG. 15A illustrates an embodiment of power stroke calculations. As shown in FIG. 15A, force is a function of scaled squared velocity during the power stroke when a user is pushing against the virtual oars: Force=k (Velocity)$^2$. FIG. 15B illustrates an embodiment of recovery stroke calculations. As shown in FIG. 15B, the difference between the force of the rower and the force of the fluid drag, multiplied by a time period, is a function of the mass of the user multiplied by the change in velocity: $(F_{rower}-F_{drag})\Delta t=m\Delta Velocity$.

Figure 16B:
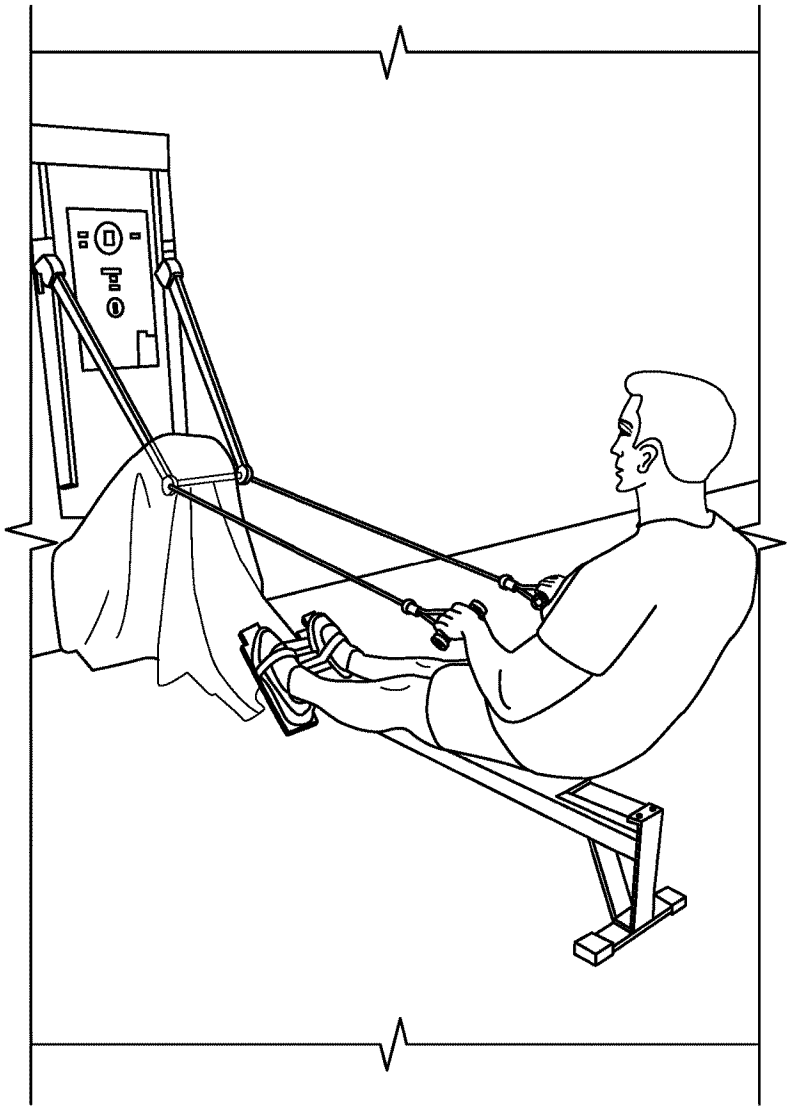
FIG. 16B is an example of a forward perspective camera.
Figure 16A:
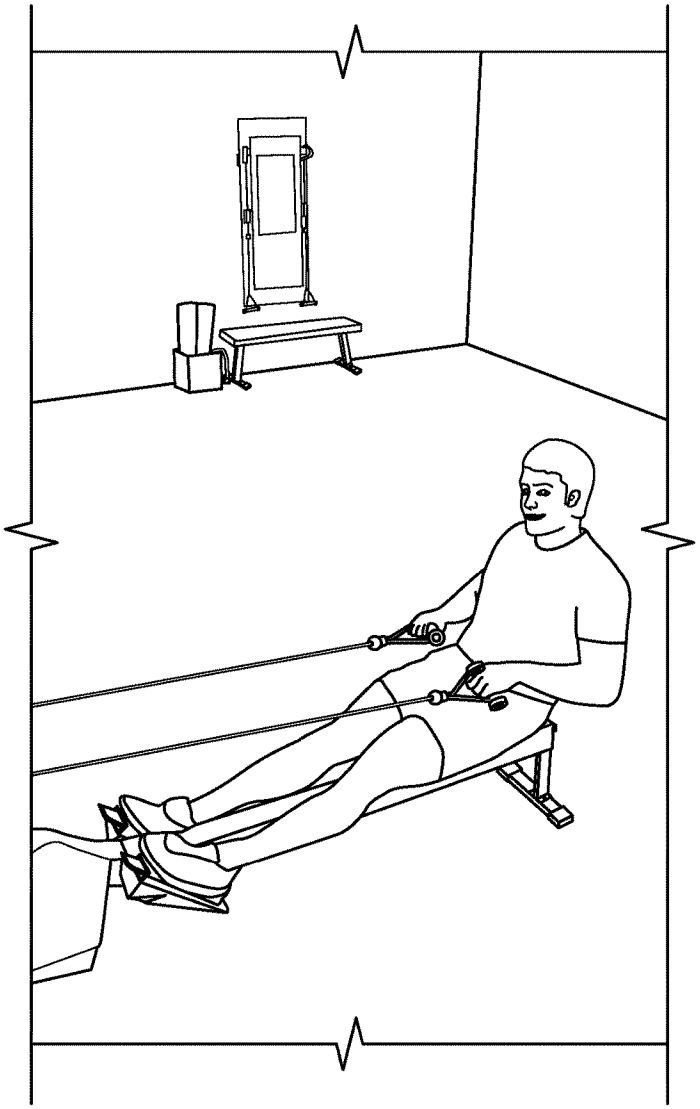
FIG. 16A is an example of an rearward perspective camera.
Figure 16D:
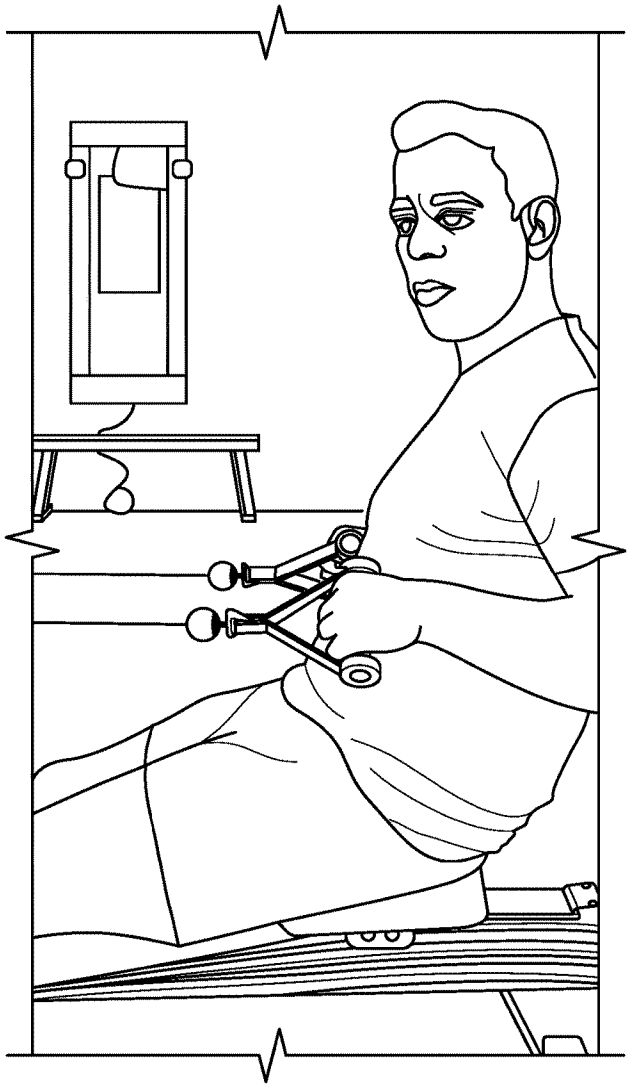
FIG. 16D is an example of a side perspective camera.
Figure 16C:
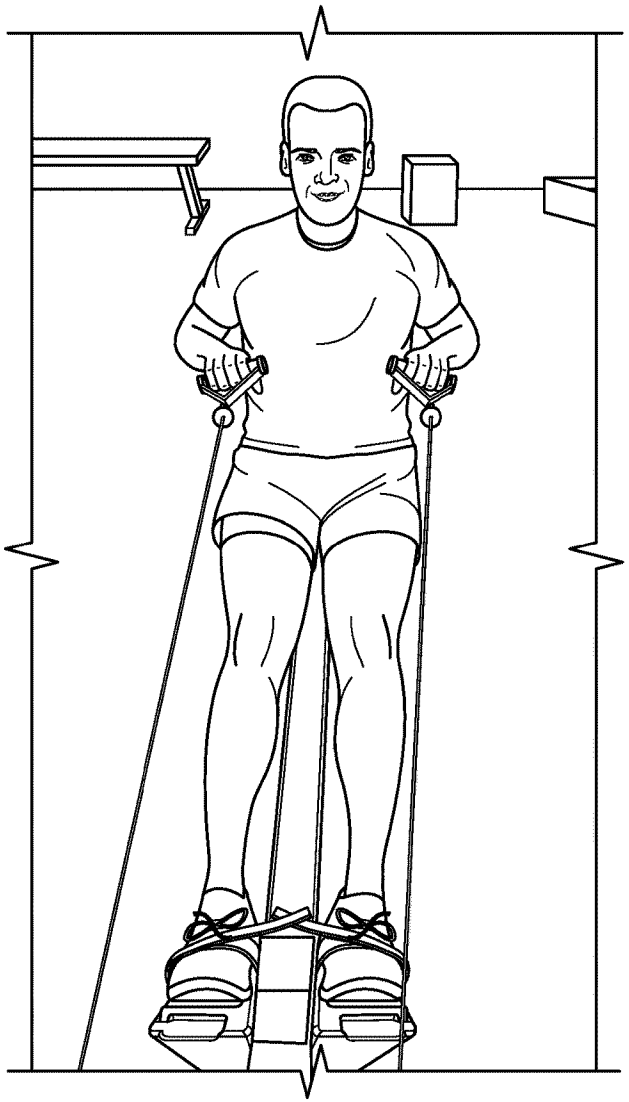
FIG. 16C is an example of a head-on perspective camera.
Figure 17:
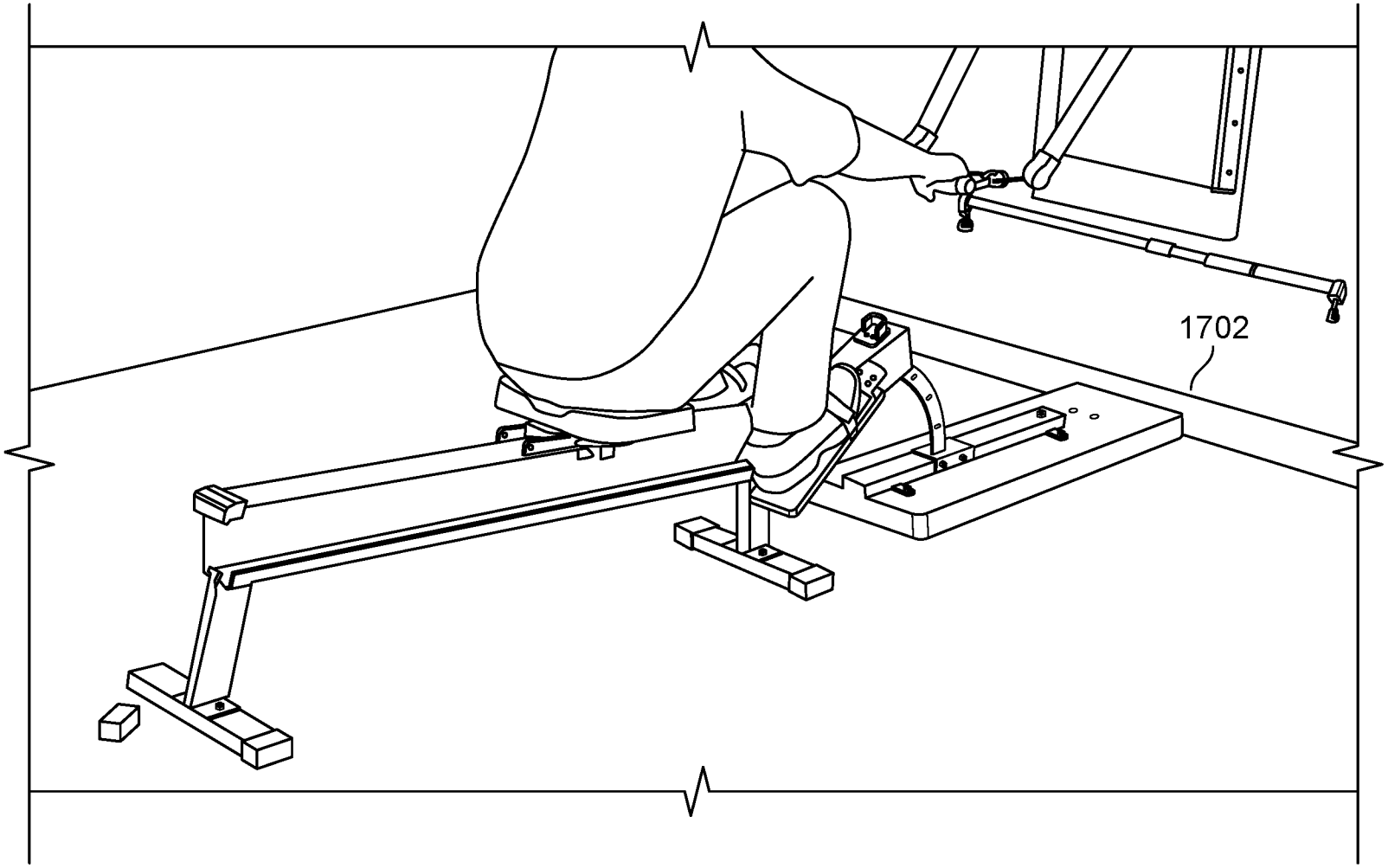
FIG. 17 is an illustration of an example of a technique to keep a constant distance from the wall.

FIGS. 16A, 16B, 16C, and 16D illustrate examples of camera sensor angles for form and/or performance coaching. FIG. 16A is an example of an rearward perspective camera. FIG. 16B is an example of a forward perspective camera. FIG. 16C is an example of a head-on perspective camera. FIG. 16D is an example of a side perspective camera. In one embodiment, one or more of these cameras are used to automatically sense rowing form using edge detection and other image/video processing algorithms. In one embodiment, one or more of these cameras are used for video streaming to a coach and/or peer for competition and/or coaching. FIG. 17 is an illustration of an example of a technique to keep a constant distance from the wall. In the example of FIG. 17, a static member (1702) is used to prevent the rowing device from "creeping" towards the wall.

Energy/Thermal Management. A strength training machine may be designed to accommodate high power dissipation, for example a professional athlete may generate 4000 watts of instantaneous power during an intense deadlift. This contrasts the average power output capability of professional athletes during aerobic exercise which may generate 400 watts on average over an hour. While a strength training machine (100) in FIG. 1A/1B may be designed to handle the instantaneous power surge using a power boost, an important technical challenge overcome in a conversion of strength training machine to aerobic exercise machine involves proper energy dissipation over that hour.

In one embodiment, a power shunt and/or resistive element may be used to dissipate electrical energy and convert it to heat for further thermal management. In one embodiment, the excess electrical energy is sold back to the electrical source such as an electrical grid. In one embodiment, the excess electrical energy is stored in a battery and/or supercapacitor for powering auxiliary devices. In one embodiment, the excess electrical power is used to turn down power requirements elsewhere in strength training machine (100).

In one embodiment, the controller for motor (102) includes a motor mode/configuration wherein the motor (102) is used as a heat sink by running the motor off-phase. For example, a brushless PMSM motor being controlled with field oriented control (FOC) typically strives for maximum power efficiency by controlling the electrical commutation to the most exact electrical angle (flux rotor position θ) possible for the given system. That is, the torque decreases and the heat increases relative to the cosine of the angle error In this embodiment, the electrical control angle is instead purposefully shifted mathematically by an inserted error angle such that more of the power generated is dissipated as heat in the motor windings instead of being converted to mechanical output power. The motor itself has a large thermal mass and in a use case where the motor is not a gating factor on the system thermal limit then it is possible to optimize other aspects of the thermal capacity of the system by running the motor off-phase. Similarly the motor may handle large peak power loads and so in a use case with large instantaneous power surges, the motor may be used to take these peak power loads and dissipate them as heat and not require other components of the system like the shunt/battery/supercapacitor/electrical conversion components to be able to handle these peak loads and overall reduce size or cost of these other components. Note that a control system is configured to provide the same torque to the user, so that the correct amount of additional power is fed to the motor to burn it as heat without affecting the torque the user feels.

Figure 18:
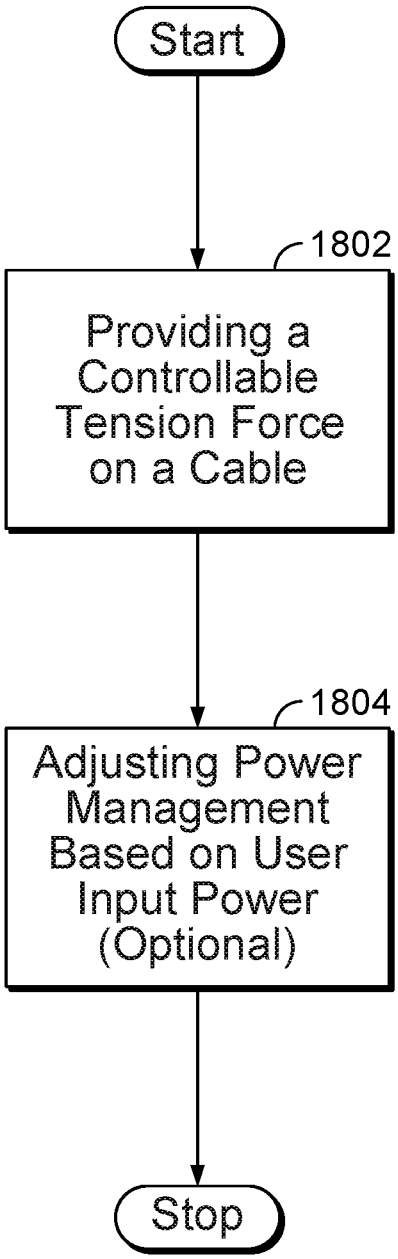
FIG. 18 is a flow chart illustrating an embodiment of a process for a converted exercise machine.

FIG. 18 is a flow chart illustrating an embodiment of a process for a converted exercise machine. In one embodiment, the process of FIG. 18 is carried out by strength training machine (100) of FIGS. 1A/1B.

In step (1802), a controllable tension force on a first cable (115) is provided. For example, the controllable tension force adjusts cable speed to be in a rowing-mode. The first cable (115) has a terminal end wherein the terminal end is adapted to attach to multiple accessories, for example accessories (120)/(130)/(140) shown in FIGS. 1B/1C/1D; and the first cable is coupled to a motor (102). One example of an accessory is a rowing handle such as that shown in FIG. 1C (130) and/or FIG. 1D (140).

The first cable (115) is routed, wherein: the first cable (115) and motor (102) are part of a resistance unit (100); and the resistance unit (100) is coupled to a user support unit (150) having a sliding seat. In one embodiment, the first cable (115) is routed by a first arm (110), which is also part of the resistance unit (100). In one embodiment, the sliding seat (150) has one or more sensors in communication with the resistance unit (100) wherein the one or more sensors provide an input that affects control of the tension force.

In one embodiment, the sliding seat (150) has one or more sensors in communication with the resistance unit (100) wherein the one or more sensors provide an input that provides form feedback. In one embodiment, a screen (105) is part of the resistance unit (100) and is configured to provide form feedback using a target band (1323) as shown for example in FIG. 13B.

In one embodiment, the user support unit is convertible to a weight bench as shown in FIGS. 8A, 8B, 9A, and 9B. In one embodiment, the resistance unit (100) further includes a second arm (110) and a second cable (115), wherein the motor (102) also provides a second controllable tension force on the second cable (115), and the second arm (110) routes the second cable (115) as shown in FIGS. 1A/1B. In one embodiment, the first arm (110) may be used by a first user and the second arm (110) may be used by a second user such that it allows the first user and second user to use the exercise machine simultaneously.

In one embodiment, the exercise machine (100) further includes a mechanical attachment. An example of a mechanical attachment is to couple the first arm and the second arm together as shown for example with harness (335) in FIG. 3B. Another example of a mechanical attachment is a grip and/or clamp to hold a mobile screen device, for example along area (330) in FIG. 3B for an additional mobile device for additional feedback, audio, video, camera, streaming, and/or messenger/video calling with a coach and/or associate/friend/family.

In one embodiment, the exercise machine (100) further includes a mechanical attachment to reduce the exercise machine creeping towards a wall as shown in FIG. 17 (1702). In one embodiment, the exercise machine (100) further includes a sensor. For example, the sensor may include at least one of the following: a camera, a depth sensing camera, a seat sensor, a push force sensor for a user foot, a pull force sensor for a user foot, a seat to rail position sensor, and a handle sensor, as described in FIG. 4C with sensor fusion.

In optional step (1804), power management is adjusted based on user input power. For example, the resistance unit (100) may further include a power adjustment module configured to adjust power management based on user input power. In one embodiment, the resistance unit (100) further includes an electrical energy storage device. In one embodiment, the motor (102) is configurable as a heat sink by running the motor off-phase. In one embodiment, the resistance unit (100) further includes a shunt resistor, coupled to the motor (102).

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. An exercise machine including:

a resistance unit including:

a first cable having a terminal end wherein the terminal end is adapted to attach to an accessory;

a screen;

a motor providing a controllable tension force simulating a power stroke experience of a rowing boat by the motor on the first cable, wherein the motor is a direct-drive hub motor; and a user support unit having a sliding seat and a detachable coupling component;

wherein the resistance unit is mounted to a wall, wherein the detachable coupling component comprises a footplate and a sensor arrangement, and wherein the sensor arrangement comprises a slide for the first cable and a position transducer associated with an angle of a handlebar grip simulating an oar position.

2. The exercise machine of claim 1, wherein the resistance unit further includes a first arm routing the first cable.

3. The exercise machine of claim 2, wherein the sliding seat has one or more sensors in communication with the resistance unit wherein the one or more sensors provide an input that affects control of the tension force.

4. The exercise machine of claim 2, wherein the sliding seat has one or more sensors in communication with the resistance unit wherein the one or more sensors provide an input that provides form feedback.

5. The exercise machine of claim 4, wherein the screen is configured to provide the form feedback using a target band.

6. The exercise machine of claim 2, wherein the user support unit is convertible to a weight bench.

7. The exercise machine of claim 2, wherein the exercise machine further includes a mechanical attachment.

8. The exercise machine of claim 2, wherein the resistance unit further includes a second arm and a second cable, wherein the motor also provides a second controllable tension force on the second cable, and the second arm routes the second cable.

9. The exercise machine of claim 8, wherein the first arm may be used by a first user and the second arm may be used by a second user such that it allows the first user and second user to use the exercise machine simultaneously.

10. The exercise machine of claim 8, wherein the exercise machine further includes a mechanical attachment to couple the first arm and the second arm together.

11. The exercise machine of claim 2, wherein the exercise machine further includes a mechanical attachment to hold a mobile screen device.

12. The exercise machine of claim 2, wherein the exercise machine further includes a mechanical attachment to reduce the exercise machine creeping towards a wall.

13. The exercise machine of claim 2, wherein the exercise machine further includes a sensor.

14. The exercise machine of claim 2, wherein the sensor arrangement further includes a sensor, wherein the sensor includes at least one of the following: a camera, a depth sensing camera, a seat sensor, a push force sensor for a user foot, a pull force sensor for a user foot, and a seat to rail position sensor.

15. The exercise machine of claim 2, wherein the resistance unit further includes a power adjustment module configured to adjust power management based on user input power by at least in part using a power shunt to dissipate excess electrical energy generated by user input power.

16. The exercise machine of claim 2, wherein the resistance unit further includes an electrical energy storage device.

17. The exercise machine of claim 2, wherein the motor is configurable as a heat sink by running the motor off-phase.

18. The exercise machine of claim 2, wherein the resistance unit further includes a shunt resistor, coupled to the motor.

19. The exercise machine of claim 2, wherein the accessory is one of one or more accessories, and one of the one or more accessories is a rowing handle.

20. The exercise machine of claim 2, wherein the controllable tension force adjusts cable speed to be in a rowing-mode.

21. A method, including:

providing a controllable tension force simulating a power stroke experience of a rowing boat on a first cable, wherein:

the first cable has a terminal end wherein the terminal end is adapted to attach to an accessory; and the first cable is coupled to a motor, wherein the motor is a direct-drive hub motor; and routing the first cable, wherein:

the first cable, and motor are part of a resistance unit;

the resistance unit is mounted to a wall; and the resistance unit is coupled to a user support unit having a sliding seat and a detachable coupling component, and wherein the detachable coupling component comprises a footplate and a sensor arrangement, and wherein the sensor arrangement comprises a slide for the first cable and a position transducer associated with an angle of a handlebar grip simulating an oar position.

* * * * *